US009595814B2

(12) United States Patent
Kasashima et al.

(10) Patent No.: US 9,595,814 B2
(45) Date of Patent: Mar. 14, 2017

(54) SPARK PLUG

(71) Applicant: NGK SPARK PLUG CO., LTD., Nagoya-shi, Aichi (JP)

(72) Inventors: Takashi Kasashima, Ichinomiya (JP); Katsuya Takaoka, Ichinomiya (JP); Kazuhiro Kurosawa, Komaki (JP); Kuniharu Tanaka, Komaki (JP); Toshitaka Honda, Nagoya (JP); Hirokazu Kurono, Nagoya (JP); Haruki Yoshida, Tajima (JP); Hironori Uegaki, Nagoya (JP)

(73) Assignee: NGK SPARK PLUG CO., LTD., Nagoya-shi (JP)

( * ) Notice: Subject to any disclaimer, the term of this patent is extended or adjusted under 35 U.S.C. 154(b) by 0 days.

(21) Appl. No.: 15/108,115

(22) PCT Filed: Dec. 25, 2014

(86) PCT No.: PCT/JP2014/084393

§ 371 (c)(1),
(2) Date: Jun. 24, 2016

(87) PCT Pub. No.: WO2015/099082

PCT Pub. Date: Jul. 2, 2015

(65) Prior Publication Data

US 2016/0329687 A1 Nov. 10, 2016

(30) Foreign Application Priority Data

Dec. 25, 2013 (JP) ..... 2013-266957

(51) Int. Cl.

| | |
|---|---|
| ***H01T 13/05*** | (2006.01) |
| ***H01T 13/41*** | (2006.01) |
| ***F02P 11/00*** | (2006.01) |

(52) U.S. Cl.
CPC ..... *H01T 13/05* (2013.01); *F02P 11/00* (2013.01); *H01T 13/41* (2013.01)

(58) Field of Classification Search
CPC ..... H01T 13/36; H01T 13/42; H01T 13/05; H01T 13/41; H01T 13/462; H01T 13/467; H01T 13/54; H01T 19/00; F02P 11/00
(Continued)

(56) References Cited

U.S. PATENT DOCUMENTS 4,713,582 A * 12/1987 Yamada ..... H01T 13/41 252/513
5,210,458 A 5/1993 McDougal ..... 313/130

FOREIGN PATENT DOCUMENTS

JP S54-151736 A 11/1979 ..... H01T 13/02
JP S61-039385 A 2/1986 ..... H01T 13/20
(Continued)

OTHER PUBLICATIONS

International Search Report issued in corresponding International Patent Application No. PCT/JP2014/084393, dated Feb. 10, 2015.

*Primary Examiner* — Anne Hines
*Assistant Examiner* — Jose M Diaz
(74) *Attorney, Agent, or Firm* — Kusner & Jaffe

(57) ABSTRACT

A connection portion connecting a center electrode and a terminal metal fixture together in a through hole of the insulator includes a resistor and a magnetic substance structure including a magnetic substance and a conductor and being disposed on a leading end side or a rear end side of the resistor while being positioned away from the resistor. The connection portion further includes a first conductive sealing portion, a second conductive sealing portion and a third conductive sealing portion. The first conductive sealing portion is disposed on a leading end side of a first member and is in contact therewith. The second conductive sealing portion is disposed between the first member and a second
(Continued)

member and is in contact with the first and second members. The third conductive sealing portion is disposed on a rear end side of the second member and is in contact therewith.

12 Claims, 5 Drawing Sheets

(58) Field of Classification Search
USPC ..... 313/118–147
See application file for complete search history.

(56) References Cited

FOREIGN PATENT DOCUMENTS

| | | | | |
|---|---|---|---|---|
| JP | S61-104580 A | 5/1986 | ..... | H01T 13/20 |
| JP | S61-135079 A | 6/1986 | ..... | H01T 13/20 |
| JP | S61-208768 A | 9/1986 | ..... | H01T 13/20 |
| JP | S61-230281 A | 10/1986 | ..... | H01C 7/00 |
| JP | S62-150681 A | 7/1987 | ..... | H01T 13/20 |
| JP | H02-284374 A | 11/1990 | ..... | F02P 13/00 |

* cited by examiner

SPARK PLUG

RELATED APPLICATIONS

This application is a National Stage of International Application No. PCT/JP2014/084393 filed Dec. 25, 2014, which claims the benefit of Japanese Patent Application No. 2013-266957, filed Dec. 23, 2013.

FIELD OF THE INVENTION

The present invention relates to a spark plug.

BACKGROUND OF THE INVENTION

Conventionally, a spark plug has been used in an internal combustion engine. Technology, by which a resistor is provided in a through hole of an insulator so as to suppress occurrence of electromagnetic noise induced by ignition, has been proposed. Technology, by which a magnetic substance is provided in the through hole of the insulator, has also been proposed.

The fact is that enough study regarding the suppression of electromagnetic noise by both the resistor and the magnetic substance has not been made.

This disclosure discloses technology by which the occurrence of electromagnetic noise can be suppressed by a resistor and a magnetic substance.

SUMMARY OF THE INVENTION

This disclosure discloses the following application examples and the like.

APPLICATION EXAMPLE 1

In accordance with a first aspect of the present invention, there is provided a spark plug comprising:

an insulator having a through hole extending in a direction of an axial line;

a center electrode, at least a part of which is inserted into a leading end side of the through hole;

a terminal metal fixture, at least a part of which is inserted into a rear end side of the through hole; and a connection portion connecting the center electrode and the terminal metal fixture together in the through hole, wherein the connection portion includes:

a resistor; and a magnetic substance structure including a magnetic substance and a conductor and being disposed on a leading end side or a rear end side of the resistor while being positioned away from the resistor, wherein, among the resistor and the magnetic substance structure, when a member disposed on a leading end side is defined as a first member and a member disposed on a rear end side is defined as a second member, the connection portion further includes:

a first conductive sealing portion that is disposed on a leading end side of the first member and is in contact with the first member;

a second conductive sealing portion that is disposed between the first member and the second member and is in contact with the first member and the second member; and a third conductive sealing portion that is disposed on a rear end side of the second member and is in contact with the second member, wherein the magnetic substance structure contains:

(1) a conductive substance as the conductor;

(2) an iron-containing oxide as the magnetic substance; and (3) a ceramic containing at least one of silicon (Si), boron (B), and phosphorous (P), and wherein, in a cross-section of the magnetic substance structure including the axial line, when a target region is defined as a rectangular region having the axial line as a center line, a side of 1.5 mm in a direction perpendicular to the axial line, and a side of 2.0 mm in the direction of the axial line, a region of the conductive substance includes a plurality of grain-shaped regions in the target region, a proportion of a number of grain-shaped regions having a maximum grain size of 200 μm or greater among the plurality of grain-shaped regions is 40% or more, and a proportion of an area of the region of the conductive substance is 35% or greater and 65% or less in the target region.

In this configuration, it is possible to suppress occurrence of an electrical contact failure at both ends of the resistor and an electrical contact failure at both ends of the magnetic substance structure by using the first, the second, and the third conductive sealing portions. Accordingly, it is possible to appropriately suppress electromagnetic noise by using both the resistor and the magnetic substance structure. Further, it is possible to appropriately suppress noise by adopting a specific configuration of the magnetic substance structure.

APPLICATION EXAMPLE 2

In accordance with a second aspect of the present invention, there is provided a spark plug as described above, wherein an electrical resistance between a leading end and a rear end of the magnetic substance structure is less than or equal to 3 kΩ.

In this configuration, it is possible to suppress heat generation of the magnetic substance structure. Accordingly, it is possible to suppress the occurrence of a failure (for example, alteration of the magnetic substance) induced by heat generation of the magnetic substance structure.

APPLICATION EXAMPLE 3

In accordance with a third aspect of the present invention, there is provided a spark plug as described above, wherein the electrical resistance between the leading end and the rear end of the magnetic substance structure is less than or equal to 1 kΩ.

In this configuration, it is possible to further suppress heat generation of the magnetic substance structure. Accordingly, it is possible to further suppress the occurrence of a failure (for example, alteration of the magnetic substance) induced by heat generation of the magnetic substance structure.

APPLICATION EXAMPLE 4

In accordance with a fourth aspect of the present invention, there is provided a spark plug as described above, wherein the conductor includes a conductive portion penetrating through the magnetic substance in the direction of the axial line.

In this configuration, it is possible to appropriately suppress electromagnetic noise while improving durability.

APPLICATION EXAMPLE 5

In accordance with a fifth aspect of the present invention, there is provided a spark plug as described above, wherein the magnetic substance structure is disposed on the rear end side of the resistor.

In this configuration, it is possible to appropriately suppress electromagnetic noise.

APPLICATION EXAMPLE 6

In accordance with a sixth aspect of the present invention, there is provided a spark plug as described above, wherein the connection portion further includes a covering portion that covers at least a part of an outer surface of the magnetic substance structure while being interposed between the magnetic substance structure and the insulator.

In this configuration, it is possible to suppress direct contact between the insulator and the magnetic substance structure.

APPLICATION EXAMPLE 7

In accordance with a seventh aspect of the present invention, there is provided a spark plug as described above, wherein the magnetic substance is made of a ferromagnetic material containing an iron oxide.

In this configuration, it is possible to appropriately suppress electromagnetic noise.

APPLICATION EXAMPLE 8

In accordance with an eighth aspect of the present invention, there is provided a spark plug as described above, wherein the ferromagnetic material is a spinel type ferrite.

In this configuration, it is possible to easily suppress electromagnetic noise.

APPLICATION EXAMPLE 9

In accordance with a ninth aspect of the present invention, there is provided a spark plug as described above, wherein the magnetic substance is a NiZn ferrite or a MnZn ferrite.

In this configuration, it is possible to appropriately suppress electromagnetic noise.

APPLICATION EXAMPLE 10

In accordance with a tenth aspect of the present invention, there is provided a spark plug as described above, wherein the conductive substance contains a perovskite type oxide which is represented by general formula $ABO_3$ and an A site in the general formula is at least one of La, Nd, Pr, Yb, and Y.

In this configuration, it is possible to further appropriately suppress electromagnetic noise.

APPLICATION EXAMPLE 11

In accordance with an eleventh aspect of the present invention, there is provided a spark plug as described above, wherein the conductive substance contains at least one metal of Ag, Cu, Ni, Sn, Fe, and Cr.

In this configuration, it is possible to further appropriately suppress electromagnetic noise.

APPLICATION EXAMPLE 12

In accordance with a twelfth aspect of the present invention, there is provided a spark plug as described above, wherein, in the target region in the cross-section of the magnetic substance structure, a porosity of a remainder of the target region other than the region of the conductive substance is less than or equal to 5%.

In this configuration, it is possible to improve durability of the magnetic substance structure.

DETAILED DESCRIPTION OF THE PREFERRED EMBODIMENTS

A. First Embodiment

A-1. Configuration of Spark Plug

Figure 1:
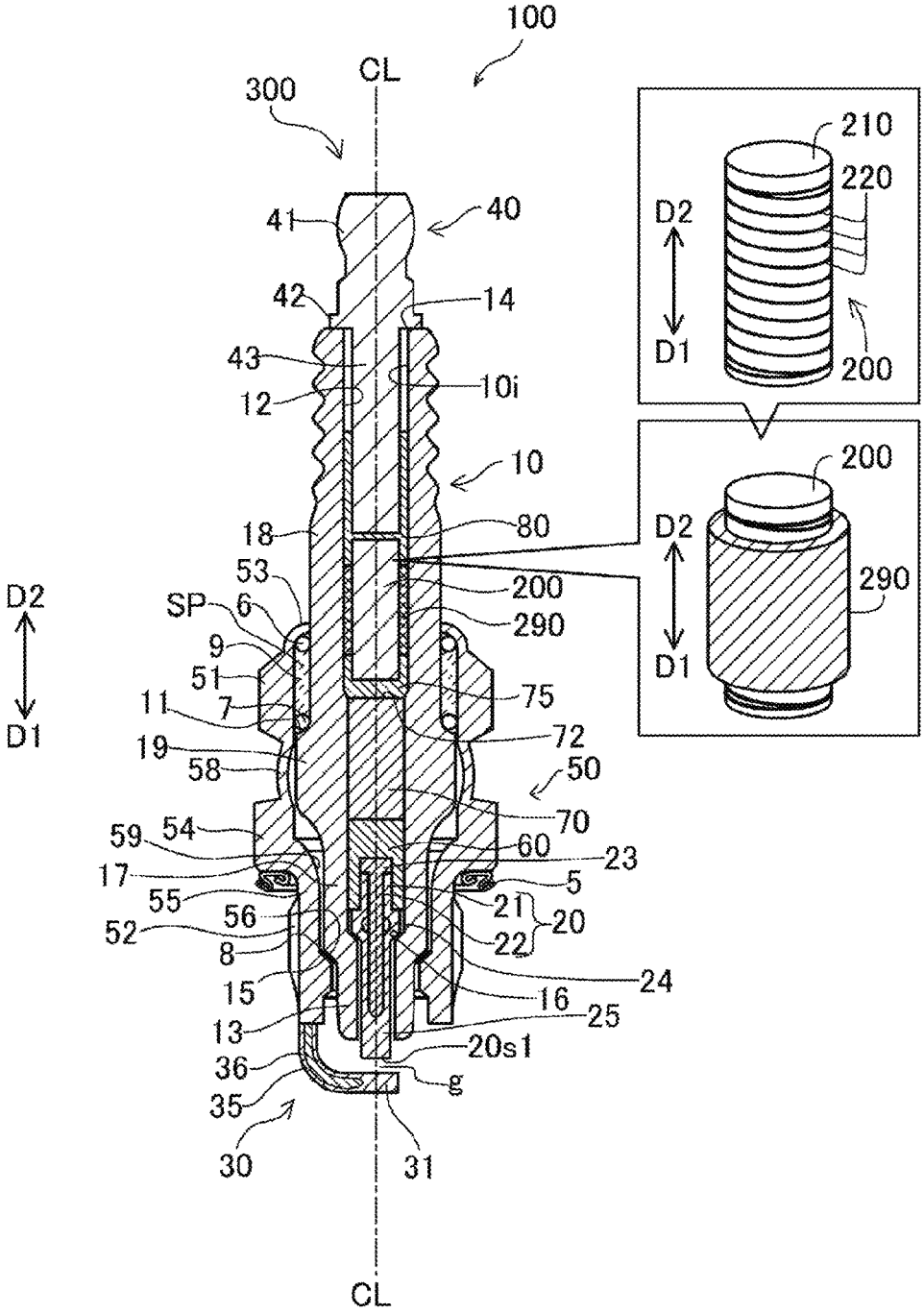
FIG. 1 is a cross-sectional view of a spark plug 100 in a first embodiment.

FIG. 1 is a cross-sectional view of a spark plug 100 in a first embodiment. An illustrated line CL is a center axis of the spark plug 100. The illustrated cross-section is a cross-section including the center axis CL. Hereinafter, the center axis CL may be referred to as an "axial line CL", and a direction parallel with the center axis CL may be referred to as a "direction of the axial line CL", or simply as an "axial direction". A radial direction of a circle centered around the center axis CL may be simply referred to as a "radial direction", and a circumferential direction of the circle centered around the center axis CL may be referred to as a "circumferential direction". In FIG. 1, among the directions parallel with the center axis CL, a downward direction may be referred to as a leading end direction D1, and an upward direction may be referred to as a rear end direction D2. The leading end direction D1 is a direction running from a terminal metal fixture 40 (to be described later) toward electrodes 20 and 30. In FIG. 1, the leading end direction D1 side is referred to as the leading end side of the spark plug 100, and the rear end direction D2 side is referred to as the rear end side of the spark plug 100.

The spark plug 100 includes an insulator 10 (may be referred to as a "ceramic insulator 10"); the center electrode 20; the ground electrode 30; the terminal metal fixture 40; a metal shell 50; a first conductive sealing portion 60; a resistor 70; a second conductive sealing portion 75; a magnetic substance structure 200; a covering portion 290; a third conductive sealing portion 80; a leading end side packing 8; talc 9; a first rear end-side packing 6; and a second rear end-side packing 7.

The insulator 10 is a substantially tubular member which extends along the center axis CL and has a through hole 12 (may be referred to as an "axial hole 12") penetrating through the insulator 10. The insulator 10 is made of alumina by firing (another insulating material may also be adopted). The insulator 10 includes a leg portion 13; a first reduced outer diameter portion 15; a leading end side trunk portion 17; a flanged portion 19; a second reduced outer diameter portion 11; and a rear end-side trunk portion 18, which line up sequentially from the leading end side toward the rear end side.

The flanged portion 19 is a portion of the insulator 10 which has the maximum outer diameter. An outer diameter of the first reduced outer diameter portion 15 positioned closer to the leading end side than the flanged portion 19 is gradually reduced from the rear end side toward the leading end side. A reduced inner diameter portion 16 is formed in the vicinity of the first reduced outer diameter portion 15 of the insulator 10 (the leading end side trunk portion 17 in the example illustrated in FIG. 1), and an inner diameter of the reduced inner diameter portion 16 is gradually reduced from the rear end side toward the leading end side. An outer diameter of the second reduced outer diameter portion 11 positioned closer to the rear end side than the flanged portion 19 is gradually reduced from the leading end side toward the rear end side.

The center electrode 20 is inserted into a leading end side of the through hole 12 of the insulator 10. The center electrode 20 is a bar-shaped member which extends along the center axis CL. The center electrode 20 includes an electrode base member 21 and a core member 22 embedded in the electrode base member 21. For example, the electrode base member 21 is made of Inconel ("INCONEL" is registered trademark) that is an alloy containing nickel as a main component. The core member 22 is made of a material (for example, an alloy containing copper) having a coefficient of thermal conductivity greater than that of the electrode base member 21.

With focus given to an outer shape of the center electrode 20, the center electrode 20 includes a leg portion 25 formed at the end of the center electrode 20 on the leading end direction D1 side; a flanged portion 24 provided on the rear end side of the leg portion 25; and a head portion 23 provided on the rear end side of the flanged portion 24. The head portion 23 and the flanged portion 24 are disposed in the through hole 12, and the surface of the flanged portion 24 on the leading end direction D1 side is supported by the reduced inner diameter portion 16 of the insulator 10. A leading end side portion of the leg portion 25 is positioned on the leading end side of the insulator 10, and is exposed to the outside from the through hole 12.

The terminal metal fixture 40 is inserted into the rear end side of the through hole 12 of the insulator 10. The terminal metal fixture 40 is made of a conductive material (metal such as low-carbon steel). An anti-corrosion metal layer may be formed on the surface of the terminal metal fixture 40. For example, a Ni layer may be formed by plating. The terminal metal fixture 40 includes a flange portion 42; a cap installation portion 41 that is formed to a portion of the terminal metal fixture 40 positioned closer to the rear end side than the flanged portion 42; and a leg portion 43 that is formed to a portion of the terminal metal fixture 40 positioned closer to the leading end side than the flanged portion 42. The cap installation portion 41 is positioned on the rear end side of the insulator 10, and is exposed to the outside from the through hole 12. The leg portion 43 is inserted into the through hole 12 of the insulator 10.

The resistor 70 suppressing electrical noise is disposed in the through hole 12 of the insulator 10 while being interposed between the terminal metal fixture 40 and the center electrode 20. The resistor 70 is made of a composite containing glass particles (for example, $B_2O_3$—$SiO_2$ based glass) as a main component, and containing ceramic particles (for example, $ZrO_2$) and a conductive material (for example, carbon particles) in addition to the glass.

The magnetic substance structure 200 suppressing electrical noise is disposed in the through hole 12 of the insulator 10 while being interposed between the resistor 70 and the terminal metal fixture 40. On the right side of FIG. 1, a perspective view of the magnetic substance structure 200 covered with the covering portion 290 and a perspective view of the magnetic substance structure 200 from which the covering portion 290 is removed are illustrated. The magnetic substance structure 200 includes a magnetic substance 210 and a conductor 220.

The magnetic substance 210 is a member that has a shape of a substantially circular column having the center axis CL as the center. For example, the magnetic substance 210 is made of a ferromagnetic material containing iron oxide. Spinel-type ferrite, hexagonal ferrite, and the like may be adopted as the ferromagnetic material containing iron oxide. NiZn (nickel-zinc) ferrite, MnZn (manganese-zinc) ferrite, CuZn (copper-zinc) ferrite, and the like may be adopted as the spinel-type ferrite.

The conductor 220 is a spiral coil surrounding the outer circumference of the magnetic substance 210. The conductor 220 is made of a metal wire, for example, an alloy wire material containing nickel and chromium as main components. The conductor 220 is wrapped around the magnetic substance 210, and extends from the vicinity of the end of the magnetic substance 210 on the leading end direction D1 side to the vicinity of the end of the magnetic substance 210 on the rear end direction D2 side.

The first conductive sealing portion 60 is disposed between the resistor 70 and the center electrode 20 in the through hole 12 while being in contact with the resistor 70 and the center electrode 20. The second conductive sealing portion 75 is disposed between the resistor 70 and the magnetic substance structure 200 while being in contact with the resistor 70 and the magnetic substance structure 200. The third conductive sealing portion 80 is disposed between the magnetic substance structure 200 and the terminal metal fixture 40 while being in contact with the magnetic substance structure 200 and the terminal metal fixture 40. The sealing portions 60, 75 and 80 contain similar glass particles as those of the resistor 70 and metal particles (Cu, Fe, and the like).

The center electrode 20 is electrically connected to the terminal metal fixture 40 via the resistor 70, the magnetic substance structure 200, and the sealing portions 60, 75, and 80. That is, the first conductive sealing portion 60, the resistor 70, the second conductive sealing portion 75, the magnetic substance structure 200, and the third conductive sealing portion 80 form a conductive path through which the center electrode 20 is electrically connected to the terminal metal fixture 40. It is possible to stabilize the contact resistance between the members 20, 60, 70, 75, 200, 80 and 40 stacked on top of each other, and to stabilize the electrical resistance value between the center electrode 20 and the terminal metal fixture 40 by using the conductive sealing portions 60, 75, and 80. Hereinafter, all of a plurality of members 60, 70, 75, 200, 290 and 80, which are disposed in the through hole 12 and connect the center electrode 20 and the terminal metal fixture 40 together, may be referred to as a "connection portion 300".

In FIG. 1, a position 72 (may be referred to as a "rear end position 72") of the end of the resistor 70 on the rear end direction D2 side is illustrated. With respect to the through hole 12 of the insulator 10, an inner diameter of a portion disposed on the rear end direction D2 side of the rear end position 72 is slightly larger than an inner diameter of a portion disposed on the leading end direction D1 side of the rear end position 72 (particularly, a portion accommodating the first conductive sealing portion 60 and the resistor 70). However, both inner diameters may be the same.

The outer circumferential surface of the magnetic substance structure 200 is covered with the covering portion 290. The covering portion 290 is a tubular member covering the outer circumference of the magnetic substance structure 200. The covering portion 290 is interposed between an inner circumferential surface 10*i* of the insulator 10 and an outer circumferential surface of the magnetic substance structure 200. The covering portion 290 is made of glass (for example, borosilicate glass). During the operation of an internal combustion engine (not illustrated) equipped with the spark plug 100, vibration is transmitted from the internal combustion engine to the spark plug 100. The vibration may cause a positional offset between the insulator 10 and the magnetic substance structure 200. However, in the spark plug 100 according to the first embodiment, the covering portion 290 disposed between the insulator 10 and the magnetic substance structure 200 absorbs vibration, and thus the positional offset between the insulator 10 and the magnetic substance structure 200 can be suppressed.

The metal shell 50 is a substantially tubular member which extends along the center axis CL and has a through hole 59 penetrating through the metal shell 50. The metal shell 50 is made of low-carbon steel (another conductive material (for example, a metal material) may also be adopted). An anti-corrosion metal layer may be formed on the surface of the metal shell 50. For example, a Ni layer may be formed by plating. The insulator 10 is inserted into the through hole 59 of the metal shell 50, and the metal shell 50 is fixed to the outer circumference of the insulator 10. The leading end of the insulator 10 (in the embodiment, a leading end side portion of the leg portion 13) is exposed to the outside at the leading end side of the through hole 59 of the metal shell 50. The rear end (in the embodiment, a rear end-side portion of the rear end-side trunk portion 18) of the insulator 10 is exposed to the outside on the rear end side of the through hole 59 of the metal shell 50.

The metal shell 50 includes a trunk portion 55; a seat portion 54; a deformed portion 58; a tool engagement portion 51; and a crimped portion 53 which line up sequentially from the leading end side toward the rear end side. The seat portion 54 is a flange-like portion. The trunk portion 55 positioned on the leading end direction D1 side of the seat portion 54 has an outer diameter smaller than that of the seat portion 54. A screw portion 52 is formed in the outer circumferential surface of the trunk portion 55, and is screwed into an attachment hole of an internal combustion engine (for example, a gasoline engine). An annular gasket 5 is fitted into the gap between the seat portion 54 and the screw portion 52, and is formed by folding a metal plate.

The metal shell 50 includes a reduced inner diameter portion 56 disposed closer to the leading end direction D1 side than the deformed portion 58. The inner diameter of the reduced inner diameter portion 56 is gradually reduced from the rear end side toward the leading end side. The leading end side packing 8 is interposed between the reduced inner diameter portion 56 of the metal shell 50 and the first reduced outer diameter portion 15 of the insulator 10. The leading end side packing 8 is a steel O-ring (another material (for example, metal material such as copper) may also be adopted).

The deformed portion 58 of the metal shell 50 is deformed in such a way that a center portion of the deformed portion 58 protrudes outward (a direction away from the center axis CL) in the radial direction. The tool engagement portion 51 is provided on the rear end side of the deformed portion 58. The tool engagement portion 51 is formed to have a shape (for example, a shape of a hexagonal column) so that a spark plug wrench can be engaged with the tool engagement portion 51. The crimped portion 53 is provided on the rear end side of the tool engagement portion 51, and has a thickness thinner than that of the tool engagement portion 51. The crimped portion 53 is disposed closer to the rear end side than the second reduced outer diameter portion 11 of the insulator 10, and forms the rear end (that is, the end on the rear end direction D2 side) of the metal shell 50. The crimped portion 53 is bent inward in the radial direction.

An annular space SP is formed between the inner circumferential surface of the metal shell 50 and the outer circumferential surface of the insulator 10, and is positioned on the rear end side of the metal shell 50. In the embodiment, the space SP is a space surrounded by the crimped portion 53 and the tool engagement portion 51 of the metal shell 50, and the second reduced outer diameter portion 11 and the rear end-side trunk portion 18 of the insulator 10. The first rear end-side packing 6 is disposed in the space SP on the rear end side, and the second rear end-side packing 7 is disposed in the space SP on the leading end side. In the embodiment, the rear end-side packings 6 and 7 are steel C-rings (another material may also be adopted). The gap between the rear end-side packings 6 and 7 in the space SP is filled with a powder of talc 9.

When the spark plug 100 is manufactured, the crimped portion 53 is crimped in such a way as to be bent inward. The crimped portion 53 is pressed toward the leading end direction D1 side. Accordingly, the deformed portion 58 is deformed, and the insulator 10 is pressed toward the leading end side via the packings 6 and 7 and the talc 9 in the metal shell 50. The leading end side packing 8 is pressed between the first reduced outer diameter portion 15 and the reduced inner diameter portion 56, and the gap between the metal shell 50 and the insulator 10 is sealed. Accordingly, the leaking of gas in a combustion chamber of an internal combustion engine to the outside through the gap between the metal shell 50 and the insulator 10 is suppressed. Further, the metal shell 50 is fixed to the insulator 10.

The ground electrode 30 is joined to the leading end (that is, the end on the leading end direction D1 side) of the metal shell 50. In the embodiment, the ground electrode 30 is a bar-shaped electrode. The ground electrode 30 extends toward the leading end direction D1 from the metal shell 50, is bent toward the center axis CL, and then reaches a leading end portion 31. A gap g is formed between the leading end portion 31 and a leading end surface 20*s*1 (a surface of 20*s*1 on the leading end direction D1 side) of the center electrode 20. The ground electrode 30 is electrically conductively joined to the metal shell 50 (for example, by laser welding). The ground electrode 30 includes a base member 35 forming the surface of the ground electrode 30, and a core portion 36 embedded in the base member 35. For example, the base member 35 is made of Inconel. The core portion 36 is made of a material (for example, pure copper) having a coefficient of thermal conductivity higher than that of the base member 35.

As described above, in the first embodiment, the magnetic substance 210 is disposed in the middle of the conductive path connecting the center electrode 20 and the terminal metal fixture 40 together. Accordingly, it is possible to suppress the occurrence of electromagnetic noise induced by discharge. Further, the conductor 220 is connected in series to at least a part of the magnetic substance 210. Accordingly, it is possible to suppress an increase in the electrical resistance between the center electrode 20 and the terminal metal fixture 40. Further, since the conductor 220 is a spiral coil, it is possible to further suppress electromagnetic noise.

A-2. Manufacturing Method

A method of manufacturing the spark plug 100 in the first embodiment can be arbitrarily adopted. For example, the following manufacturing method can be adopted. First, the insulator 10, the center electrode 20, the terminal metal fixture 40, a material powder for each of the conductive sealing portions 60, 75 and 80, a material powder for the resistor 70, and the magnetic substance structure 200 are prepared. The magnetic substance structure 200 is formed by wrapping the conductor 220 around the magnetic substance 210 formed by a well-known method.

Subsequently, the center electrode 20 is inserted into the insulator 10 through an opening (hereinafter, referred to as a "rear opening 14") of the through hole 12 on the rear end direction D2 side. As illustrated in FIG. 1, the center electrode 20 is supported by the reduced inner diameter portion 16 of the insulator 10 such that the center electrode 20 is disposed at a predetermined position in the through hole 12.

Subsequently, the filling of the material powders for the first conductive sealing portion 60, the resistor 70, and the second conductive sealing portion 75 into the through hole 12 and molding of the filled powder materials are performed in the order of the members 60, 70 and 75. The filling of the powder materials into the through hole 12 is performed through the rear opening 14. The molding of the filled powder materials is performed by using a bar inserted through the rear opening 14. The material powder is molded into substantially the same shape as that of the corresponding member.

Subsequently, the magnetic substance structure 200 is inserted into the through hole 12 through the rear opening 14, and is disposed on the rear end direction D2 side of the second conductive sealing portion 75. The gap between the magnetic substance structure 200 and the inner circumferential surface 10*i* of the insulator 10 is filled with material powder for the covering portion 290. Subsequently, the filling of material powder for the third conductive sealing portion 80 into the through hole 12 is performed through the rear opening 14. The insulator 10 is heated up to a predetermined temperature higher than the softening point of a glass component contained in each of the material powders, and the terminal metal fixture 40 is inserted into the through hole 12 through the rear opening 14 of the through hole 12 with the insulator 10 heated at the predetermined temperature. As a result, the material powders are compressed and sintered such that the conductive sealing portions 60, 75 and 80, the resistor 70, and the covering portion 290 are formed.

Subsequently, the metal shell 50 is assembled to the outer circumference of the insulator 10, and the ground electrode 30 is fixed to the metal shell 50. Subsequently, the ground electrode 30 is bent, and the manufacturing of a spark plug is complete.

B. Second Embodiment

Figure 2:
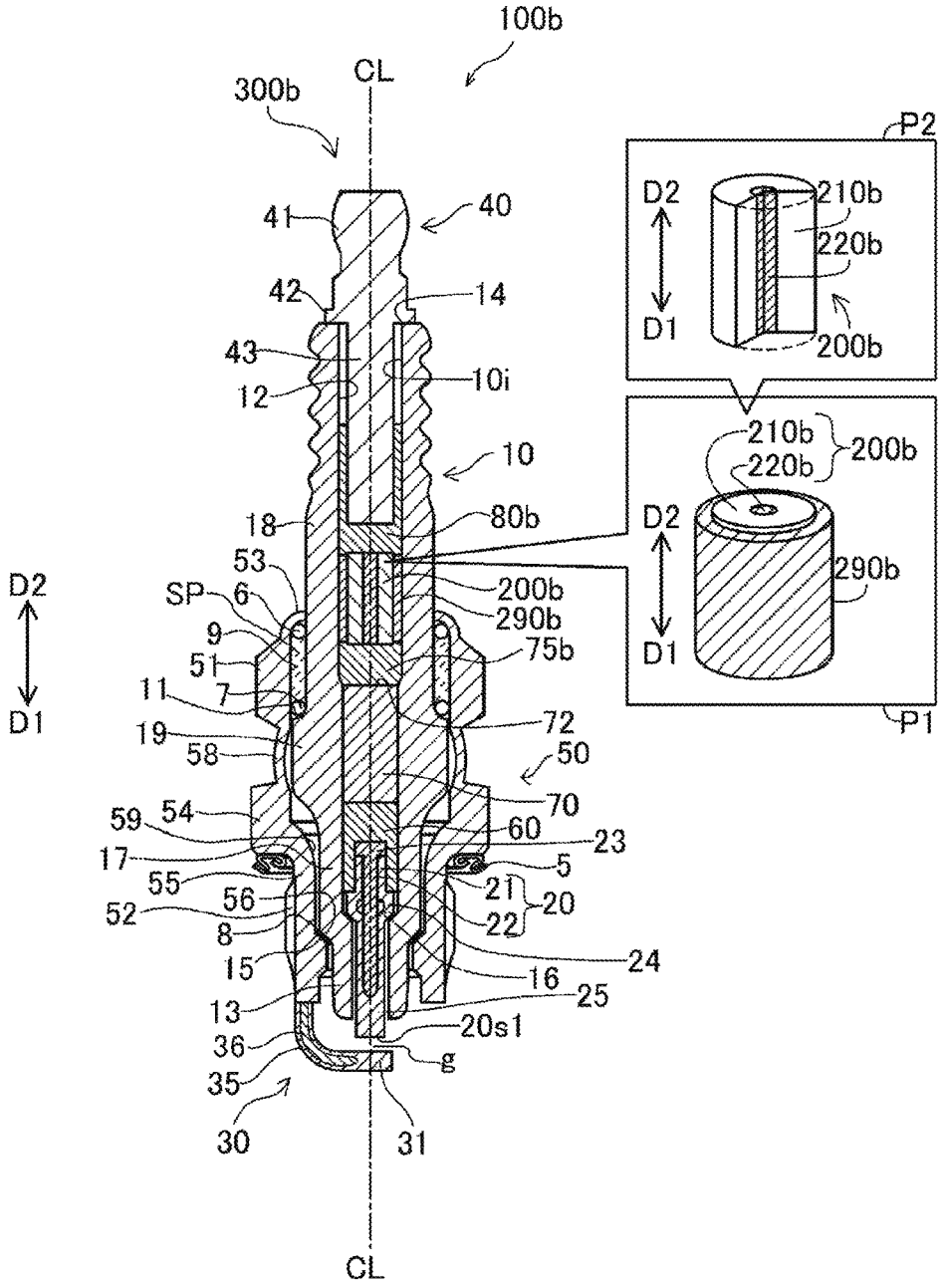
FIG. 2 is a cross-sectional view of a spark plug 100*b* in a second embodiment.

FIG. 2 is a cross-sectional view of a spark plug 100*b* in a second embodiment. The spark plug 100*b* is different from the spark plug 100 in the first embodiment only in that the magnetic substance structure 200 is replaced with a magnetic substance structure 200*b*. The remainder of the configuration of the spark plug 100*b* is the same as that of the spark plug 100 in FIG. 1. The same reference signs will be assigned to the same elements in FIG. 2 as those in FIG. 1, and description thereof will be omitted.

As illustrated, the magnetic substance structure 200*b* is disposed between the resistor 70 and the terminal metal fixture 40 in the through hole 12 of the insulator 10. On the right side of FIG. 2, a perspective view (referred to as a "first perspective view P1") of the magnetic substance structure 200*b* covered with a covering portion 290*b* and a perspective view (referred to as a "second perspective view P2") of the magnetic substance structure 200*b* from which the covering portion 290*b* is removed are illustrated. The second perspective view P2 illustrates a partially cut-out magnetic substance structure 200*b* so as to show the internal configuration of the magnetic substance structure 200*b*.

As illustrated, the magnetic substance structure 200*b* includes a magnetic substance 210*b* and a conductor 220*b*. The conductor 220*b* is cross-hatched in the second perspective view P2. The magnetic substance 210*b* is a tubular member centered around the center axis CL. Similar to the magnetic substance 210 in FIG. 1, various magnetic materials (for example, a ferromagnetic material containing iron oxide) can be adopted as the material of the magnetic substance 210*b*.

The conductor 220*b* penetrates through the magnetic substance 210*b* along the center axis CL. The conductor 220*b* extends from the end of the magnetic substance 210*b* on the leading end direction D1 side to the end of the magnetic substance 210*b* on the rear end direction D2 side. Similar to the conductor 220 in FIG. 1, various conductive materials (for example, an alloy containing nickel and chromium as main components) can be adopted as the material of the conductor 220*b*.

The outer circumferential surface of the magnetic substance structure 200*b* is covered with the covering portion 290*b* Similar to the covering portion 290 in FIG. 1, the covering portion 290*b* is a tubular member covering the magnetic substance structure 200*b*. Since the covering portion 290*b* is interposed between the inner circumferential surface 10*i* of the insulator 10 and the outer circumferential surface of the magnetic substance structure 200*b*, the positional offset between the insulator 10 and the magnetic substance structure 200*b* is suppressed. Similar to the covering portion 290 in FIG. 1, various materials (glass such as borosilicate glass) can be adopted as the material of the covering portion 290*b*.

A second conductive sealing portion 75*b* is disposed between the magnetic substance structure 200*b* and the resistor 70 in the through hole 12 while being in contact with the magnetic substance structure 200*b* and the resistor 70. A third conductive sealing portion 80*b* is disposed between the magnetic substance structure 200*b* and the terminal metal fixture 40 while being in contact with the magnetic substance structure 200*b* and the terminal metal fixture 40. Similar to the conductive sealing portions 75 and 80 in FIG. 1, various conductive materials (for example, a material containing similar glass particles as those of the resistor 70, and metal particles (Cu, Fe, and the like)) can be adopted as the material of each of the conductive sealing portions 75*b* and 80*b*.

The end of the magnetic substance structure 200*b* on the leading end direction D1 side, that is, the end of each of the magnetic substance structure 210*b* and the conductor 220*b* on the leading end direction D1 side is electrically connected to the resistor 70 via the second conductive sealing portion 75*b*. The end of the magnetic substance structure 200*b* on the rear end direction D2 side, that is, the end of each of the magnetic substance structure 210*b* and the conductor 220*b* on the rear end direction D2 side is electrically connected to the terminal metal fixture 40 via the third conductive sealing portion 80*b*. The first conductive sealing portion 60, the resistor 70, the second conductive sealing portion 75*b*, the magnetic substance structure 200*b*, and the third conductive sealing portion 80*b* form a conductive path through which the center electrode 20 is electrically connected to the terminal metal fixture 40. It is possible to stabilize the contact resistance between the members 20, 60, 70, 75*b*, 200*b*, 80*b* and 40 stacked on top of each other, and to stabilize the electrical resistance between the center electrode 20 and the terminal metal fixture 40 by using the conductive sealing portions 60, 75*b* and 80*b*. Hereinafter, all of a plurality of members 60, 70, 75*b*, 200*b*, 290*b* and 80*b*, which are disposed in the through hole 12 and connect the center electrode 20 and the terminal metal fixture 40 together, may be referred to as a "connection portion 300*b*".

As described above, in the second embodiment, the magnetic substance 210*b* is disposed in the middle of the conductive path connecting the center electrode 20 and the terminal metal fixture 40 together. Accordingly, it is possible to suppress the occurrence of electromagnetic noise induced by discharge. Further, the conductor 220*b* is connected in series to the magnetic substance 210*b*. Accordingly, it is possible to suppress an increase in the electrical resistance between the center electrode 20 and the terminal metal fixture 40. Further, the conductor 220*b* is embedded in the magnetic substance 210*b*. That is, the entirety of the conductor 220*b* except for both ends is covered with the magnetic substance 210*b*. Accordingly, it is possible to suppress damage to the conductor 220*b*. For example, the occurrence of a short circuit of the conductor 220*b* induced by vibration can be suppressed.

The spark plug 100*b* in the second embodiment can be manufactured using the same method as the spark plug 100 in the first embodiment. The magnetic substance structure 200*b* is formed by inserting the conductor 220*b* into a through hole of the magnetic substance 210*b* formed by a well-known method.

C. Reference Example

Figure 3:
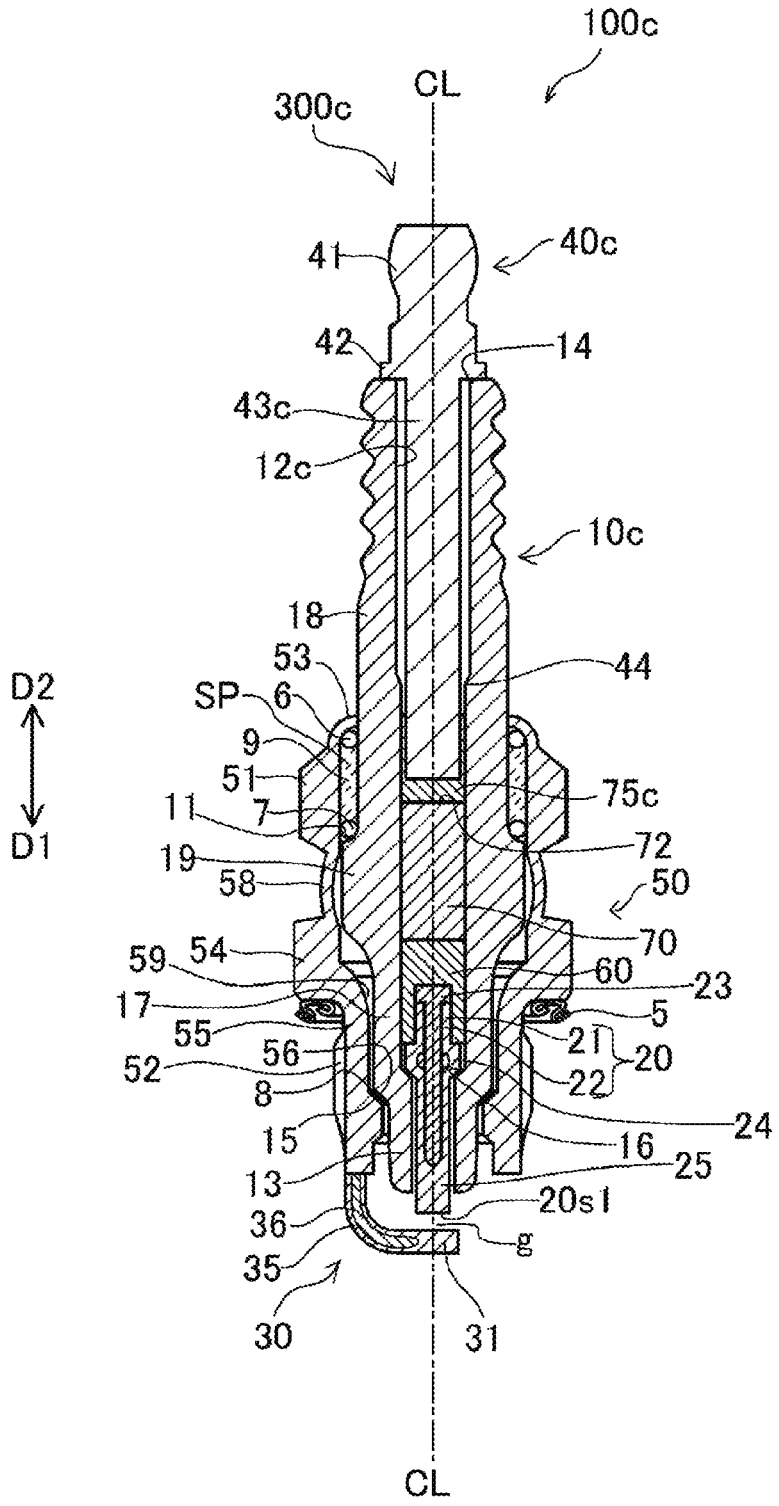
FIG. 3 is a cross-sectional view of a spark plug 100*c* in a reference example.

FIG. 3 is a cross-sectional view of a spark plug 100*c* in a reference example. The spark plug 100*c* is used as a reference example in evaluation tests to be described later. The spark plug 100*c* is different from the spark plug 100 in FIG. 1 in that the magnetic substance structures 200 and the third conductive sealing portion 80 are omitted, and is different from the spark plug 100*b* in FIG. 2 in that the magnetic substance structure 200*b* and the third conductive sealing portion 80*b* are omitted. In the reference example, a leg portion 43*c* of a terminal metal fixture 40*c* is longer than the leg portion 43 in the embodiments such that the end of the leg portion 43*c* on the leading end direction D1 side reaches the vicinity of the resistor 70. A second conductive sealing portion 75*c* is disposed between the leg portion 43*c* and the resistor 70 while being in contact with the leg portion 43*c* and the resistor 70. The same material as that of the second conductive sealing portion 75 in the embodiments can be adopted as the material of the second conductive sealing portion 75*c*.

In FIG. 3, an intermediate position 44 (referred to as an "intermediate position 44") of a portion of a through hole 12*c* of an insulator 10*c* accommodating the leg portion 43*c* is illustrated. With respect to the through hole 12*c*, an inner diameter of a portion disposed on the rear end direction D2 side of the intermediate position 44 is slightly larger than an inner diameter of a portion disposed on the leading end direction D1 side of the intermediate position 44 (particularly, a portion accommodating the first conductive sealing portion 60, the resistor 70, the second conductive sealing portion 75*c*, and a portion of the leg portion 43*c*). However, both inner diameters may be the same.

The remainder of the configuration of the spark plug 100*c* in the reference example is the same as those of the spark plugs 100 and 100*b* illustrated in FIGS. 1 and 2. All of the first conductive sealing portion 60, the resistor 70, and the second conductive sealing portion 75*c* form a connection portion 300*c* connecting the center electrode 20 and the terminal metal fixture 40*c* together in the through hole 12*c*. The spark plug 100*c* in the reference example can be manufactured using the same method as the spark plugs 100 and 100*b* in the embodiments.

D. Evaluation Test

D-1. Configuration of Spark Plug Samples

Evaluation tests performed on a plurality of types of spark plug samples will be described. Table 1 below illustrates the configuration of each sample, and each evaluation result of four evaluation tests.

TABLE 1

| No. | Configuration | Existence or Non-existence of Covering Portion | Electromagnetic Noise Characteristics | Impact Resistance Characteristics | Resistance Stability | Durability |
|---|---|---|---|---|---|---|
| 1 | A | Yes | 10 | 10 | 10 | 10 |
| 2 | B | Yes | 6 | 10 | 10 | 10 |
| 3 | C | — | Reference | 10 | 10 | 10 |
| 4 | D | Yes | 5 | 10 | 10 | 10 |
| 5 | E | Yes | 4 | 10 | 10 | 10 |
| 6 | A | No | 10 | 5 | 10 | 10 |
| 7 | B | No | 6 | 5 | 10 | 10 |
| 8 | F | Yes | 5 | 10 | 10 | 10 |
| 9 | G | Yes | 6 | 10 | 10 | 1 |
| 10 | H | Yes | 8 | 10 | 10 | 10 |
| 11 | I | Yes | — | 0 | 0 | 1 |
| 12 | J | Yes | — | 0 | 0 | 1 |
| 13 | K | Yes | 10 | 10 | 10 | 10 |

In the evaluation tests, 13 types of samples with different configurations were evaluated. The table illustrates numbers indicating sample types, reference signs indicating configuration types, the existence or non-existence of a covering portion, the evaluation results of electromagnetic noise characteristics, the evaluation results of impact resistance characteristics, the evaluation results of resistance stability, and the evaluation results of durability.

The correlations between the reference signs indicating the configuration types and the configurations of the spark plugs are as described below.

A: the configuration illustrated in FIG. 1

B: the configuration illustrated in FIG. 2

C: the configuration illustrated in FIG. 3

D: a configuration in which the dispositions of the resistor 70 and the magnetic substance structure 200 in the configuration in FIG. 1 are switched E: a configuration in which the dispositions of the resistor 70 and the magnetic substance structure 200*b* are switched F: a configuration in which the magnetic substance 210 in the configuration in FIG. 1 is replaced with a member made of alumina and having the same shape as the magnetic substance 210

G: a configuration in which the conductor 220*b* in the configuration in FIG. 2 is replaced with a conductor with 2 kΩ resistance H: configuration in which the conductor 220*b* in the configuration in FIG. 2 is replaced with a conductor with 1 kΩ resistance I: a configuration in which the third conductive sealing portion 80 is omitted from the configuration in FIG. 1

J: a configuration in which the second conductive sealing portion 75 is omitted from the configuration in FIG. 1

K: a configuration in which the conductor 220*b* in the configuration in FIG. 2 is replaced with a conductor with 200 kΩ resistance Here, as illustrated in Table 1, the existence or non-existence of the covering portions 290, 290*b* are determined independently from the configurations A to K.

Features common to the configurations A to K are as described below.

1) the material of the resistor 70: a composite containing $B_2O_3$—$SiO_2$ based glass, $ZrO_2$ as ceramic particles, and C as conductive material 2) the material of the magnetic substances 210, 210*b*: MnZn ferrite 3) the material of the conductors 220, 220*b*: an alloy containing nickel and chromium as main components 4) the material of the conductive sealing portions 60, 75, 75*b*, 80, 80*b* and 80*c*: a composite containing $B_2O_3$—$SiO_2$ based glass and Cu as metal particles The electrical resistance of the conductor is the electrical resistance between the end of the conductor on the leading end direction D1 side and the end of the conductor on the rear end direction D2 side. Hereinafter, the electrical resistance between the end of the conductor on the leading end direction D1 side and the end of the conductor on the rear end direction D2 side is referred to as an end-to-end resistance. Hereinafter, the results of each of the evaluation tests will be described.

D-2. Evaluation Test on Electromagnetic Noise Characteristics

The electromagnetic noise characteristics were evaluated using an insertion loss measured according to the method specified in JASO D002-2. Specifically, the improvement (unit is dB) of the insertion loss at a frequency of 300 MHz when a $3^{rd}$ sample was used as a datum was adopted as an evaluation result. An evaluation result denoted by "m (m is an integer which is zero or greater and ten or less)" implies that the improvement of the insertion loss with respect to the $3^{rd}$ sample is m (dB) or greater and less than m+1 (dB). For example, an evaluation result denoted by "5" implies that the improvement is 5 dB or greater and less than 6 dB. An evaluation result was determined to be "10" when the improvement was 10 dB or greater. In the evaluation result, an average value of the insertion losses of five samples with the same configuration was used as the insertion loss of each type of sample. The five samples having the electrical resistance between the center electrode 20 and the terminal metal fixture 40, 40*c* in a range with a center value of 5 kΩ and a width of 0.6 kΩ, that is, a range of 4.7 kΩ or greater and 5.3 kΩ or less were adopted. Since $11^{th}$ and $12^{th}$ samples had a large variation in the electrical resistance, and five samples with the aforementioned range of electrical resistance could not obtained, the $11^{th}$ and $12^{th}$ samples were not evaluated.

As illustrated in Table 1, when a $1^{st}$ sample was compared to an $8^{th}$ sample, the evaluation result of the $1^{st}$ sample including the magnetic substance 210 was better than that of the $8^{th}$ sample from which the magnetic substance 210 was omitted. As such, it was possible to suppress electromagnetic noise by providing the magnetic substance 210.

The evaluation result of each of the $1^{st}$ sample and a $6^{th}$ sample including the coil-shaped conductor 220 was "10" which was the highest grade, and the evaluation result of each of a $2^{nd}$ sample and a $7^{th}$ sample including the straight conductor 220*b* was "6" which is less than 10. As such, it was possible to considerably suppress electromagnetic noise by providing the coil-shaped conductor 220.

When the $1^{st}$ sample was compared to a $4^{th}$ sample, the evaluation result of the $1^{st}$ sample in which the magnetic substance structure 200 was disposed closer to the rear end direction D2 side than the resistor 70 was better than that of the $4^{th}$ sample in which the magnetic substance structure 200 was disposed closer to leading end direction D1 side than the resistor 70. Similarly, when the $2^{nd}$ sample was compared to a $5^{th}$ sample, the evaluation result of the $2^{nd}$ sample in which the magnetic substance structure 200*b* was disposed closer to the rear end direction D2 side than the resistor 70 was better than that of the $5^{th}$ sample in which the magnetic substance structure 200*b* was disposed closer to the leading end direction D1 side than the resistor 70. As such, it was possible to suppress electromagnetic noise by disposing the magnetic substance structure on the rear end direction D2 side of the resistor regardless of the configuration of the magnetic substance structure.

When at least one of the second conductive sealing portion 75 and the third conductive sealing portion 80 interposing the magnetic substance structure 200 therebetween was omitted (the $11^{th}$ sample and the $12^{th}$ sample), it was difficult to stabilize the electrical resistance between the center electrode 20 and the terminal metal fixture 40. In contrast, it was possible to stabilize the electrical resistance by providing the second conductive sealing portion 75 and the third conductive sealing portion 80.

D-3. Evaluation Result of Impact Resistance Characteristics

The impact resistance characteristics were evaluated according to the impact resistance test specified in 7.4 of JIS B8031:2006. An evaluation result denoted by "0" implies the occurrence of abnormality in the impact resistance test. When no abnormality was observed in the impact resistance test, a vibration test was additionally performed for 30 minutes. The difference between an electrical resistance measured before the evaluation test and an electrical resistance measured after the evaluation test was calculated. The electrical resistance is the electrical resistance between the center electrode 20 and the terminal metal fixture 40, 40*c*. An evaluation result denoted by "5" implies that an absolute value of the difference between the electrical resistances exceeds 10% of the electrical resistance before the test. An evaluation result denoted by "10" implies that an absolute value of the difference between the electrical resistances is 10% or less of the electrical resistance before the test.

As illustrated in Table 1, the evaluation result of each of the $11^{th}$ sample and $12^{th}$ sample, from which at least one of the second conductive sealing portion 75 and the third conductive sealing portion 80 interposing the magnetic substance structure 200 therebetween was omitted, was "0". In contrast, the evaluation results of the $1^{st}$ to $10^{th}$ samples and a $13^{th}$ sample, which include two conductive sealing portions (for example, the conductive sealing portions 75 and 80 in FIG. 1) interposing the magnetic substance structure 200, 200*b* therebetween, were "5" or "10" which was better than those of the $11^{th}$ sample and the $12^{th}$ sample. As such, by interposing the magnetic substance structure 200, 200*b* between the two conductive sealing portions, it was possible to improve impact resistance.

Further, the evaluation result of each of the $6^{th}$ sample and $7^{th}$ sample, in which the magnetic substance structure 200, 200*b* was interposed between the two conductive sealing portions but which did not include the covering portion 290, 290*b*, the evaluation result of each of these samples was "5". In contrast, the evaluation result of each of the $1^{st}$ to $5^{th}$ samples, the $8^{th}$ to $10^{th}$ samples, and the $13^{th}$ sample, which include the two conductive sealing portions interposing the magnetic substance structure 200, 200*b* therebetween and the covering portion 290, 290*b*, was "10". As such, it was possible to considerably improve the impact resistance by providing the covering portion 290, 290*b*. However, the covering portion 290, 290*b* may be omitted.

D-4. Evaluation Result of Resistance Stability

The resistance stability was evaluated based on a standard deviation in the electrical resistances between the center electrode 20 and the terminal metal fixture 40, 40*c*. As described above, the spark plugs used in the evaluation tests were manufactured by heating the insulator 10 in a state where the material of the connection portion (for example, the connection portion 300 in FIG. 1) was disposed in the through hole 12, 12*c*. The powder materials of the conductive sealing portions 60, 75, 75*b*, 75*c*, 80, and 80*b* might flow due to the heating. A variation in the electrical resistance might occur due to the flowing of the powder materials. The magnitude in the variation was evaluated. Specifically, 100 spark plugs with the same configuration were manufactured for each sample type. The electrical resistances between the center electrode 20 and the terminal metal fixture 40, 40*c* were measured, and a standard deviation in the measured electrical resistances was calculated. An evaluation result denoted by "0" implies that the standard deviation is greater than 0.8, an evaluation result denoted by "5" implies that the standard deviation is greater than 0.5 and 0.8 or less, and an evaluation result denoted by "10" implies that the standard deviation is 0.5 or less.

As illustrated in Table 1, the evaluation result of each of the $11^{th}$ sample and the $12^{th}$ sample, from which at least one of the second conductive sealing portion 75 and the third conductive sealing portion 80 interposing the magnetic substance structure 200 therebetween was omitted, was "0". In contrast, the evaluation result of each of the $1^{st}$ to $10^{th}$ samples, and the $13^{th}$ sample, which include the two conductive sealing portions (for example, the conductive sealing portions 75 and 80 in FIG. 1) interposing the magnetic substance structures 200, 200*b* therebetween, was "10" which was better than those of the $11^{th}$ sample and the $12^{th}$ sample. As such, by interposing the magnetic substance structure 200, 200*b* between the two conductive sealing portions, it was possible to considerably stabilize the electrical resistance.

D-5. Evaluation Result of Durability

The durability is durability against discharge. The spark plug sample was connected to an automotive transistorized ignition system, and discharge was repeatedly performed under the following conditions so as to evaluate the durability.

Temperature: 350 degrees Celsius
Voltage Applied to Spark Plug: 20 kV
Discharge Period: 3,600 incidences/minute
Operation Time: 100 hours The evaluation test was performed under the aforementioned conditions, and thereafter, the electrical resistance between the center electrode 20 and the terminal metal fixture 40, 40*c* was measured at a room temperature. The evaluation result was determined to be "10" when the electrical resistance after the evaluation test was less than 1.5 times the electrical resistance before the evaluation test. The evaluation result was determined to be "1" when the electrical resistance after the evaluation test was greater than or equal to 1.5 times the electrical resistance before the evaluation test.

As illustrated in Table 1, the evaluation result of the $2^{nd}$ sample including the conductor 220*b* was "10". The evaluation result of the $13^{th}$ sample including the conductor with 200 kΩ resistance instead of the conductor 220*b* was "10". The evaluation result of the $10^{th}$ sample including the conductor with 1 kΩ resistance instead of the conductor 220*b* was "10". The evaluation result of the $9^{th}$ sample including the conductor with 2 kΩ resistance instead of the conductor 220*b* was "1". The end-to-end resistance of the conductor 220*b* was approximately 50 kΩ. As such, it was possible to improve durability against discharge by reducing the end-to-end resistance of the conductor (specifically, the conductor connected to the magnetic substance 210*b*) of the magnetic substance structure.

The reason it was possible to improve durability against discharge by reducing the end-to-end resistance of the conductor of the magnetic substance structure can be estimated as follows. That is, since current flows through the conductor connected to the magnetic substance 210*b* during discharge, the conductor generates heat. The magnitude of current during discharge is adjusted in such a way that a proper spark occurs at the gap g regardless of the internal configuration of the spark plug. Accordingly, the greater the end-to-end resistance of the conductor is, the higher the temperature of the conductor may become. When the temperature of the conductor is increased, a short circuit of the conductor is more likely to occur. When the conductor is short circuited, the electrical resistance between the center electrode 20 and the terminal metal fixture 40 may be increased. In addition, when the temperature of the conductor is increased, the temperature of the magnetic substance 210*b* is also increased. The magnetic substance 210*b* is prone to damage when the temperature of the magnetic substance 210*b* is high compared to when the temperature is low (for example, the cracking of the magnetic substance 210*b* occurs). An increase in the end-to-end resistance of the magnetic substance 210*b* induced by damage to the magnetic substance 210*b* may cause an increase in the electrical resistance between the center electrode 20 and the terminal metal fixture 40. As described above, the smaller the end-to-end resistance of the conductor is, the further it is possible to suppress the occurrence of damage to the magnetic substance 210*b* and a short circuit of the conductor. As a result, it can be estimated that it is possible to improve durability against discharge. Further, when the end-to-end resistance of the conductor is high, since current flows along the surface of the conductor during discharge, electromagnetic noise may occur. For this reason, the conductor of the magnetic substance structure preferably has a low end-to-end resistance.

The end-to-end resistances of the conductors 220*b* of the $2^{nd}$, the $13^{th}$, and $10^{th}$ samples, the evaluation results of which were "10" indicating good durability, were 50 kΩ, 200 kΩ, and 1 kΩ, respectively. An arbitrary value among these values can be adopted as the upper limit of a preferable range (range of a lower limit or greater and an upper limit or less) of the end-to-end resistance of the conductor 220*b*. An arbitrary value less than or equal to the upper limit among these values can be adopted as the lower limit. For example, a value of 1 kΩ or less can be adopted as the end-to-end resistance of the conductor 220*b*. More preferably, a value of 200 kΩ or less can be adopted as the end-to-end resistance of the conductor 220*b*. In addition to the aforementioned values, a value of 0 kΩ can be adopted as the lower limit of the preferable range of the end-to-end resistance of the conductor 220*b*.

The aforementioned description has been given with reference to the evaluation results of the $2^{nd}$, the $10^{th}$, the $11^{th}$, and the $13^{th}$ samples with the configuration illustrated in FIG. 2. However, it can be estimated that the relationship between heat generation of the conductor and the likeliness of occurrence of a failure (a short circuit of the conductor or damage to the magnet) can be applied regardless of the configuration of the magnetic substance structure. Accordingly, also in the spark plug with the configuration illustrated in FIG. 1, it can be estimated that, the lower the end-to-end resistance of the coil-shaped conductor 220 is, the further it is possible to suppress the occurrence of a short circuit of the conductor 220 or damage to the magnetic substance 210 to thus improve durability against discharge. Conductive metal such as an iron material or copper is preferably adopted as the material of the coil-shaped conductor 220. Particularly, stainless steel or a nickel alloy is preferably adopted upon consideration of heat resistance and costs.

During discharge, current may flow through not only the conductor 220, 220*b* but also the magnetic substance 210, 210*b*. Accordingly, the magnetic substance structure 200, 200*b* which is an assembly of the magnetic substance 210, 210*b* and the conductor 220, 200*b* preferably has low end-to-end resistances so as to suppress the occurrence of damage to the magnetic substance 210, 210*b*. For example, a range of 0 kΩ or greater and 3 kΩ or less can be adopted as a preferable range of the end-to-end resistance of the magnetic substance structure 200, 200*b*. However, a value greater than 3 kΩ may be adopted. The end-to-end resistances of the conductors of the $2^{nd}$, the $13^{th}$, and $10^{th}$ samples, the evaluation results of which showed good durability, were 50 kΩ, 200 kΩ, and 1 kΩ, respectively. When it is taken into consideration that such conductors are adopted, an arbitrary value among these end-to-end resistances can be adopted as the upper limit of the preferable range (range of a lower limit or greater and an upper limit or less) of the end-to-end resistance of the magnetic substance structure 200, 200*b*. An arbitrary value less than or equal to the upper limit among these values can be adopted as the lower limit. For example, a value of 1 kΩ or less can be adopted as the end-to-end resistance of the magnetic substance structure 200, 200*b*. More preferably, a value of 200 kΩ or less can be adopted as the end-to-end resistance of the magnetic substance structure 200, 200*b*. In addition to the aforementioned values, a value of 0 kΩ can be adopted as the lower limit of the preferable range of the end-to-end resistance of the magnetic substance structure 200, 200*b*.

Preferably, the end-to-end resistance of the conductor 220, 220*b* is respectively lower than that of the magnetic substance 210, 210*b* so as to suppress heat generation of the magnetic substance structure 200, 200*b*. In this configuration, it is possible to reduce the end-to-end resistance of the magnetic substance structure 200, 200*b* by connecting the conductor 220, 220*b* to the magnetic substance 210, 210*b*. As a result, it is possible to suppress heat generation of the magnetic substance structure 200, 200*b*. In each of the $1^{st}$ to the $13^{th}$ samples, the end-to-end resistance of the magnetic substance 210, 210*b* was several kΩ and was greater than the end-to-end resistance of the conductor (for example, the conductor 220, 220*b*). As illustrated in Table 1, the evaluation results of the $1^{st}$ to $8^{th}$, the $10^{th}$, and the $13^{th}$ samples showed good durability.

As illustrated in Table 1, the evaluation results of the $11^{th}$ and the $12^{th}$ samples, in which at least one of the second conductive sealing portion 75 and the third conductive sealing portion 80 interposing the magnetic substance structure 200 therebetween was omitted, were "1". Each of the $1^{st}$ to $8^{th}$, the $10^{th}$, and the $13^{th}$ samples with a good evaluation result of "10" included two conductive sealing portions (for example, the conductive sealing portions 75 and 80 in FIG. 1) between which the magnetic substance structure 200, 200*b* was interposed. As such, since the magnetic substance structure 200, 200*b* was interposed between the two conductive sealing portions, it was possible to improve durability against discharge.

The following method can be adopted as a method of measuring the end-to-end resistance of the magnetic substance structure of the spark plug. Hereinafter, the spark plugs 100 and 100*b* in FIGS. 1 and 2 will be described as examples. First, an operator disassembles the metal shell 50 from the insulator 10, cuts the insulator 10 using a cutting tool such as a diamond blade, and takes the connection portion 300, 300*b* disposed in the through hole 12 out of the through hole 12. Subsequently, the operator respectively disassembles the conductive sealing portions in contact with the magnetic substance structure 200, 200*b* from the magnetic substance structure 200, 200*b* using a cutting tool such as a nippers. Subsequently, after the operator observes the internal structure of each of the covering portion 290, 290*b* in contact with the magnetic substance structure 200, 200*b* using a CT scanner, the operator disassembles the covering portion 290, 290*b* from the magnetic substance structure 200, 200*b* by cutting and grinding the magnetic substance structure 200, 200*b*. The operator brings the probes of a resistance meter into contact with both ends (on the leading end direction D1 side and the rear end direction D2 side) of the magnetic substance structure 200, 200*b* obtained in this manner, and measures an end-to-end resistance therebetween.

The following method can be adopted as a method of measuring the end-to-end resistance of the conductor of the magnetic substance structure. That is, the operator acquires the conductor 220, 220*b* by removing the magnetic substance 210, 210*b* from the magnetic substance structure 200, 200*b* obtained by the aforementioned method using a cutting tool such as nippers. The operator brings the probes of a resistance meter into contact with both ends on the leading end direction D1 side and the rear end direction D2 side of the conductor 220, 220*b* obtained in this manner, and measures an end-to-end resistance therebetween.

The following method can be adopted as a method of measuring the end-to-end resistance of the magnetic substance of the magnetic substance structure. That is, after the operator observes the internal structure of the magnetic substance structure 200, 200*b* using a CT scanner, the operator obtains the magnetic substance 210, 210*b* by cutting and grinding the magnetic substance structure 200, 200*b*. The operator brings the probes of a resistance meter into contact with both ends on the leading end direction D1 side and the rear end direction D2 side of the magnetic substance 210, 210*b*, and measures an end-to-end resistance therebetween.

At least one of both ends on the leading end direction D1 side and the rear end direction D2 side of each of the magnetic substance structure, the conductor, and the magnetic substance may be a surface. In this case, the minimum end-to-end resistance obtained by bringing the probe of a resistance meter into contact with the surface at an arbitrary position is adopted.

E. Third Embodiment

E-1. Configuration of Spark Plug

Figure 4:
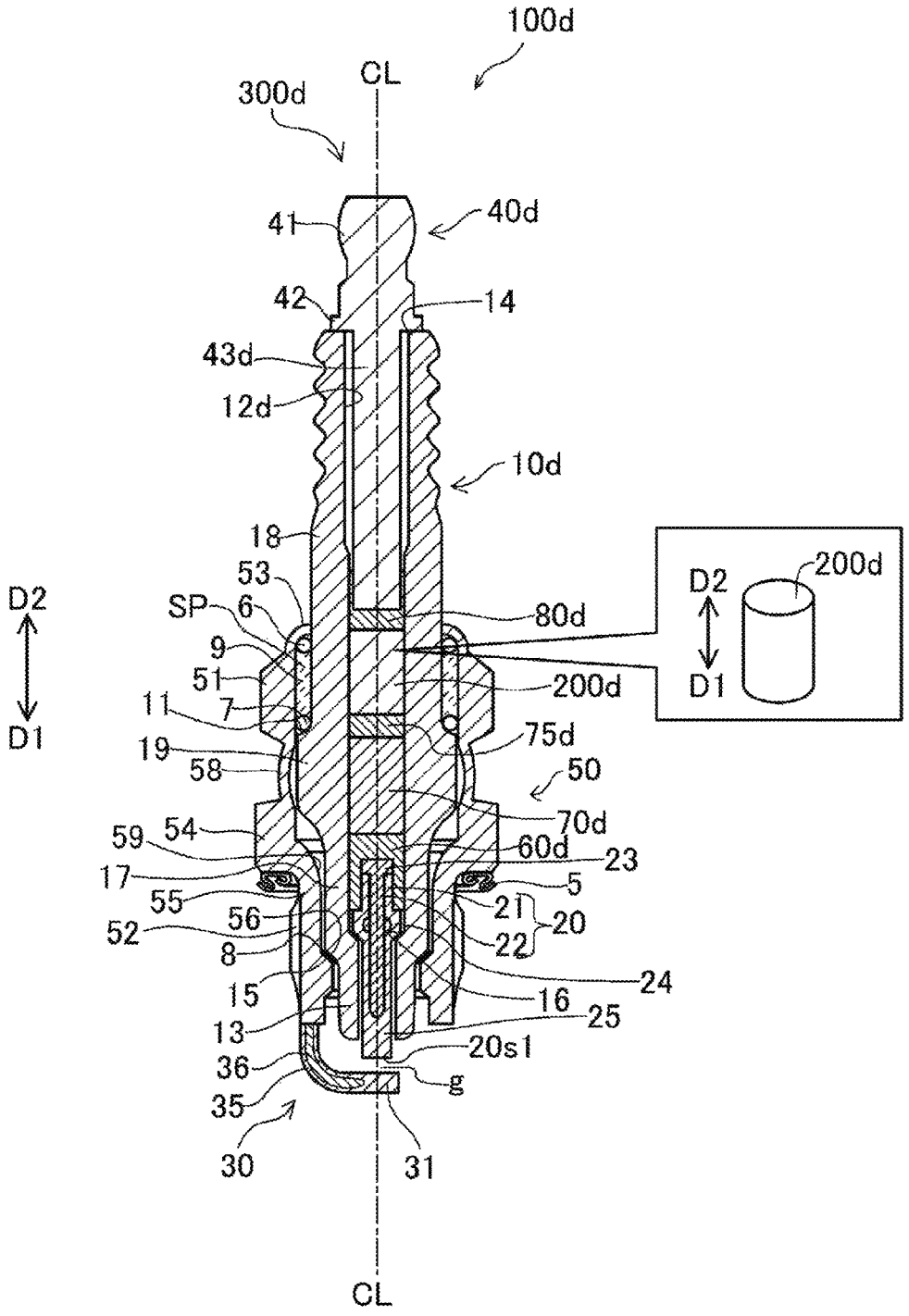
FIG. 4 is a cross-sectional view of a spark plug 100*d* in a third embodiment.

FIG. 4 is a cross-sectional view of a spark plug 100*d* in a third embodiment. In the third embodiment, a magnetic substance structure 200*d* is provided instead of the magnetic substance structures 200 and 200*b* in FIGS. 1 and 2. A perspective view of the magnetic substance structure 200*d* is illustrated on the right side of FIG. 4. The magnetic substance structure 200*d* is a tubular member centered around the center axis CL. A portion of the center electrode 20 on the rear end direction D2 side, a first conductive sealing portion 60*d*, a resistor 70*d*, a second conductive sealing portion 75*d*, the magnetic substance structure 200*d*, a third conductive sealing portion 80*d*, and a leg portion 43*d* of a terminal metal fixture 40*d* are disposed in a through hole 12*d* of an insulator 10*d* sequentially from the leading end direction D1 side toward the rear end direction D2 side. The magnetic substance structure 200*d* is disposed on the rear end direction D2 side of the resistor 70*d*. All of the members 60*d*, 70*d*, 75*d*, 200*d* and 80*d* form a connection portion 300*d* connecting the center electrode 20 and the terminal metal fixture 40*d* together in the through hole 12*d*. The remainder of the configuration of the spark plug 100*d* in the third embodiment is substantially the same as the configuration of each of the spark plugs 100 and 100*b* in FIGS. 1 and 2. In FIG. 4, the same reference signs will be assigned to portions of the spark plug 100*d* in the third embodiment, which correspond to the portions of each of the spark plugs 100 and 100*b* in FIGS. 1 and 2. The description thereof will be omitted.

Figure 5:
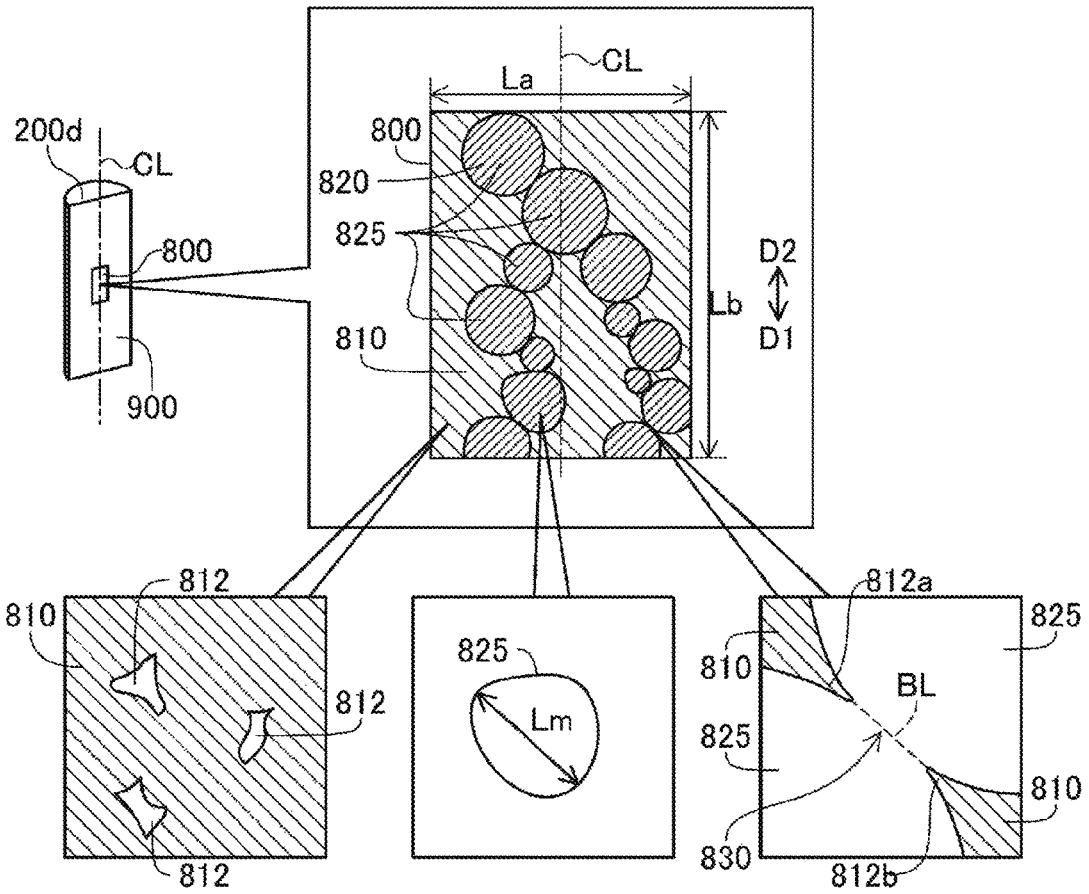
FIG. 5 shows views illustrating a magnetic substance structure 200*d*.

FIG. 5 shows views illustrating the magnetic substance structure 200*d*. A perspective view of the magnetic substance structure 200*d* is illustrated on the left upper side of FIG. 5. The perspective view illustrates the partially cut-out magnetic substance structure 200*d*. A cross-section 900 in the perspective view is the planar cross-section of the magnetic substance structure 200*d*, which includes the center axis CL. An enlarged schematic view of a portion 800 (hereinafter, referred to as a "target region 800") of the cross-section 900 is illustrated on the center upper side of FIG. 5. The target region 800 is a rectangular region having the center axis CL as the center axis, and is formed by two sides parallel with the center axis CL and two sides perpendicular to the center axis CL. The shape of the target region 800 is symmetric with respect to the center axis serving as the symmetric axis CL, that is, the target region 800 has a line-symmetric shape. A first length La in FIG. 5 is a length in a direction perpendicular to the center axis CL of the target region 800, and a second length Lb is a length parallel with the center axis CL of the target region 800. The first length La is 1.5 mm, and the second length Lb is 2.0 mm.

As illustrated, the target region 800 (that is, the cross-section of the magnetic substance structure 200*d*) contains a ceramic region 810 and a conductive region 820. The conductive region 820 is formed by a plurality of grain-shaped regions 825 (hereinafter, referred to as "conductive grain regions 825" or also simply referred to as "grain regions 825").

The conductive region 820 is formed of a conductive substance. Carbon, carbon-containing compounds (TiC and the like), perovskite type oxides ($LaMnO_3$ and the like), metal (Cu and the like), or the like can be adopted as the conductive substance. As illustrated, a plurality of conductive grain regions 825 are in contact with each other to form a current path extending from the rear end direction D2 side toward the leading end direction D1 side. The plurality of conductive grain regions 825 are formed of a conductive substance powder as the material of the magnetic substance structure 200*d*. For example, one conductive grain region 825 can be formed of one of conductive substance grains contained in the material powder. A plurality of conductive substance grains contained in the material powder stick together to form one conductive grain region 825.

One conductive grain region 825 illustrates the cross-section of one three-dimensional grain-like region of the conductive substance. Two conductive grain regions 825 may be disposed separately from each other in the target region 800 (that is, the cross-section 900), which is not illustrated. The two conductive grain regions 825 positioned away from each other in the target region 800 may illustrate the cross-sections of two three-dimensional grain-like regions which are in contact with each other at a position at a front side or a back side of the target region 800. As such, the plurality of conductive grain regions 825 in contact with each other or positioned away from each other in the target region 800 are capable of forming a current path extending from the rear end direction D2 side toward the leading end direction D1 side. During discharge, current flows through the plurality of conductive grain regions 825 in the magnetic substance structure 200*d*.

The ceramic region 810 is formed of a mixed material containing a magnetic substance and a ceramic. An iron-containing oxide (for example, $Fe_2O_3$) can be adopted as the magnetic substance. For example, a ceramic containing at least one of silicon (Si), boron (B), and phosphorous (P) can be adopted as the ceramic. For example, a ceramic such as glass described in the first embodiment can be adopted. For example, a substance containing one or more oxides arbitrarily selected from silica ($SiO_2$), boric acid ($B_2O_5$), and phosphoric acid ($P_2O_5$) can be adopted as the glass.

As illustrated, the plurality of conductive grain regions 825 are surrounded by the ceramic region 810 containing the magnetic substance. That is, the current path is surrounded by the magnetic substance. When the magnetic substance is disposed in the vicinity of the conductive path, electromagnetic noise induced by discharge is suppressed. For example, the conductive path serves as an inductance element, and suppresses electromagnetic noise. In addition, an increase in the impedance of the conductive path suppresses electromagnetic noise.

One grain region 825 is illustrated on the center lower side of the FIG. 5. A distance Lm is the maximum grain size (is referred to as the "maximum grain size Lm") of the grain region 825. The maximum grain size Lm of one grain region 825 is the length of the longest line among lines connecting edges of the grain region 825 together without bulging out of the grain region 825. The fact that the maximum diameter Lm of each of a plurality of grain regions 825 is large implies that the current path is large. The durability of the current path is improved as the current becomes larger. Accordingly, it is possible to improve the durability of the current path, that is, the durability of the magnetic substance structure 200*d* as the number of conductive grain regions 825 with the maximum grain size Lm (for example, the maximum grain size Lm greater than or equal to 200 μm) among the plurality of grain regions 825 contained in the target region 800 is increased.

When two grain regions 825 are in contact with each other in the target region 800, the boundary line between the two grain regions 825 may be unclear. In this case, the boundary line can be specified as follows. An enlarged view on the right lower side of FIG. 5 illustrates a contact portion 830 of the two grain regions 825 in contact with each other. When the boundary line is unclear, the contact portion 830 is formed by two protruding portions 812*a* and 812*b* of the ceramic region 810, which face each other. The shortest straight line BL connecting the two protruding portions 812*a* and 812*b* may be adopted as the boundary line. The maximum grain size Lm can be specified using the boundary line BL.

The ceramic region 810 is formed of a magnetic substance powder and a ceramic powder as the material of the magnetic substance structure 200*d*. Accordingly, pores may be formed in the ceramic region 810 in the target region 800. An enlarged view of the ceramic region 810 is illustrated on the left lower side of FIG. 5. As illustrated, pores 812 are formed in the ceramic region 810. During discharge of the spark plug 100*d*, discharge may partially occur in the pores 812. The partial discharge occurring in the pores 812 may cause aging of the magnetic substance structure 200*d*, and the occurrence of electromagnetic noise. Accordingly, the proportion of the pores 812 in the magnetic substance structure 200*d* (the proportion of an area of the pores 812 to an area of the remainder of the target region 800 which is other than the conductive region 820) is preferably small.

E-2. Manufacturing Method

The spark plug 100*d* including the magnetic substance structure 200*d* can be manufactured according to the same sequence as in the manufacturing method described in the first embodiment. The members in the through hole 12*d* of the insulator 10*d* are formed as described below. Material powders for the conductive sealing portions 60*d*, 75*d*, and 80*d*, the resistor 70*d*, and the magnetic substance structure 200*d* are prepared. The same material powders as for the conductive sealing portions 60, 75, and 80, and the resistor 70 in the first embodiment can be adopted as the material powders for the conductive sealing portions 60*d*, 75*d*, and 80*d*, and the resistor 70*d*. For example, the material powder for the magnetic substance structure 200*d* is prepared as described below. A mixed material is prepared by mixing a magnetic substance powder and a ceramic powder. The material powder for the magnetic substance structure 200*d* is prepared by mixing the mixed material with a conductive substance powder.

Subsequently, similar to the manufacturing method in the first embodiment, the center electrode 20 is disposed at a predetermined position in which the center electrode 20 is supported by the reduced inner diameter portion 16 in the through hole 12*d*. The filling of the material powders for the first conductive sealing portion 60*d*, the resistor 70*d*, the second conductive sealing portion 75*d*, the magnetic substance structure 200*d*, and the third conductive sealing portion 80*d* into the through hole 12*d*, and molding of the filled powder materials are performed in the order of the members 60*d*, 70*d*, 75*d*, 200*d*, and 80*d*. The filling of the powder materials into the through hole 12*d* is performed through the rear opening 14. The molding of the filled powder materials is performed by using a bar inserted through the rear opening 14. The material powder is molded into substantially the same shape as that of the corresponding member.

The insulator 10*d* is heated up to a predetermined temperature higher than the softening point of a glass constituent contained in each of the material powders, and the terminal metal fixture 40*d* is inserted into the through hole 12*d* through the rear opening 14 of the through hole 12*d* with the insulator 10*d* heated at the predetermined temperature. As a result, each material powder is compressed and sintered such that the conductive sealing portions 60*d*, 75*d*, and 80*d*, the resistor 70*d*, and the magnetic substance structure 200*d* are formed. In the embodiment, the insulator 10*d* is heated to a temperature not causing melting of the conductive substance powder contained in the material of the magnetic substance structure 200*d*. Accordingly, the plurality of conductive grain regions 825 (refer to FIG. 5) come into a substantially point contact with each other.

F. Evaluation Test

F-1. Outline

Evaluation tests performed on a plurality of types of samples of the spark plug 100*d* in the third embodiment will be described. Tables 2 and 3 below illustrate the configuration of each sample, and each of results of the evaluation tests.

TABLE 2

| No. | Conductive Substance: Composition | Occupancy (%) | Large Grain Proportion (%) (Lm ≥200 μm) | Fe-containing Oxide | Ceramic Elements Contained | Porosity (%) |
|---|---|---|---|---|---|---|
| A-1 | $Cr_3C_2$ | 35 | 40 | $Fe_2O_3$ | Si, Mg, Ba, Ca | 5.4 |
| A-2 | TiC | 65 | 92 | $Fe_3O_4$ | P, Mg, Ba, Na | 5.6 |
| A-3 | C | 48 | 45 | $(Ni,Zn)Fe_2O_4$ | B, Ca, Mg, P, Na, K | 6.1 |
| A-4 | $SrTiO_3$ | 61 | 51 | FeO | Si, P, Mg, Ba, Li | 5.3 |
| A-5 | $SrCrO_3$ | 52 | 55 | $BaFe_{12}O_{19}$ | B, Ca, Mg, P, Na, K | 5.3 |
| A-6 | Ti | 58 | 77 | $SrFe_{12}O_{19}$ | Si, B, Mg, Sr | 5.6 |
| A-7 | $LaMnO_3$ | 49 | 43 | $(Ni,Zn)Fe_2O_4$ | B, Ca, Mg, P, Na, K | 5.6 |
| A-8 | $LaCrO_3$ | 39 | 45 | $NiFe_2O_4$ | Si, P, Mg, Ba, Li | 5.2 |
| A-9 | $LaCoO_3$ | 44 | 46 | $Fe_2O_3$ | B, Ca, Mg, P, Na, K | 5.4 |
| A-10 | $LaFeO_3$ | 48 | 44 | $(Ni,Zn)Fe_2O_4$ | Si, B, Mg, Sr | 5.7 |
| A-11 | $NdMnO_3$ | 51 | 42 | $(Mn,Zn)Fe_2O_4$ | P, Mg, Ba, Na | 5.5 |
| A-12 | $PrMnO_3$ | 50 | 40 | $Ba_2Co_2Fe_{12}O_{22}$ | B, Ca, Mg, Li | 5.2 |
| A-13 | $YbMnO_3$ | 62 | 41 | $(Ni,Zn)Fe_2O_4$ | Si, P, Mg, Ba, Li | 5.6 |
| A-14 | $YMnO_3$ | 64 | 43 | $CuFe_2O_4$ | B, Ca, Mg, P, Na, K | 5.3 |
| A-15 | Ag | 44 | 95 | $CuFe_2O_4$ | Si, P, Mg, Ba, Li | 5.5 |
| A-16 | Cu | 47 | 44 | $BaFe_{12}O_{19}$ | B, Ca, Mg, P, Na, K | 5.1 |
| A-17 | Ni | 60 | 57 | $SrFe_{12}O_{19}$ | Si, B, Mg, Sr | 5.6 |
| A-18 | Sn | 55 | 83 | $NiFe_2O_4$ | P, Mg, Ba, Na | 5.7 |
| A-19 | Fe | 59 | 76 | $(Ni,Zn)Fe_2O_4$ | B, Ca, Mg, Li | 6 |
| A-20 | Cr | 64 | 67 | $NiFe_2O_4$ | Si, P, Mg, Ba, Li | 5.4 |
| A-21 | Inconel | 62 | 50 | $Ba_2Co_2Fe_{12}O_{22}$ | B, Ca, Mg, P, Na, K | 5.6 |
| A-22 | Sendust | 65 | 55 | $Y_3Fe_5O_{12}$ | P, Mg, Ca, Ti, K, Li | 5.8 |
| A-23 | Permalloy | 40 | 71 | $(Mn,Zn)Fe_2O_4$ | P, Mg, Ba, Na | 5.5 |
| A-24 | $NdMnO_3$ | 58 | 55 | $(Ni,Zn)Fe_2O_4$ | Si, B, Mg, Sr | 5 |
| A-25 | $PrMnO_3$ | 46 | 63 | $(Mn,Zn)Fe_2O_4$ | P, Mg, Ba, Na | 4.4 |
| A-26 | $YbMnO_3$ | 52 | 71 | $Ba_2Co_2Fe_{12}O_{22}$ | B, Ca, Mg, Li | 4.3 |
| A-27 | $YMnO_3$ | 58 | 59 | $(Ni,Zn)Fe_2O_4$ | Si, P, Mg, Ba, Li | 3.8 |
| A-28 | Fe | 64 | 52 | $BaFe_{12}O_{19}$ | B, Ca, Mg, P, Na, K | 3.5 |
| A-29 | Cr | 61 | 66 | $SrFe_{12}O_{19}$ | Si, P, Mg, Ba, Li | 3.3 |
| A-30 | Inconel | 56 | 61 | $NiFe_2O_4$ | B, Ca, Mg, P, Na, K | 3.2 |

| No. | Noise (dB) Before Durability Test: 30 MHz | 100 MHz | 300 MHz | 500 MHz | Noise (dB) After Durability Test: 30 MHz | 100 MHz | 300 MHz | 500 MHz |
|---|---|---|---|---|---|---|---|---|
| A-1 | 76 | 70 | 64 | 60 | 86 | 80 | 74 | 70 |
| A-2 | 75 | 70 | 64 | 59 | 84 | 79 | 73 | 68 |
| A-3 | 75 | 71 | 62 | 59 | 86 | 82 | 73 | 70 |
| A-4 | 74 | 69 | 63 | 60 | 84 | 79 | 73 | 70 |
| A-5 | 76 | 70 | 65 | 59 | 85 | 79 | 74 | 68 |
| A-6 | 75 | 71 | 64 | 58 | 86 | 82 | 75 | 69 |
| A-7 | 68 | 62 | 58 | 50 | 75 | 69 | 65 | 57 |
| A-8 | 69 | 61 | 57 | 51 | 75 | 67 | 63 | 57 |
| A-9 | 69 | 63 | 59 | 51 | 75 | 69 | 65 | 57 |
| A-10 | 68 | 62 | 58 | 50 | 75 | 69 | 65 | 57 |
| A-11 | 67 | 62 | 57 | 51 | 74 | 69 | 64 | 58 |
| A-12 | 69 | 63 | 57 | 52 | 75 | 69 | 63 | 58 |
| A-13 | 67 | 61 | 58 | 51 | 73 | 67 | 64 | 57 |
| A-14 | 68 | 61 | 56 | 52 | 74 | 67 | 62 | 58 |
| A-15 | 67 | 61 | 58 | 51 | 74 | 68 | 65 | 58 |
| A-16 | 68 | 62 | 56 | 51 | 74 | 68 | 62 | 57 |
| A-17 | 66 | 61 | 57 | 51 | 72 | 67 | 63 | 57 |
| A-18 | 67 | 61 | 56 | 50 | 74 | 68 | 63 | 57 |
| A-19 | 68 | 61 | 58 | 51 | 75 | 68 | 65 | 58 |
| A-20 | 66 | 62 | 56 | 51 | 72 | 68 | 62 | 57 |
| A-21 | 68 | 62 | 57 | 51 | 74 | 68 | 63 | 57 |
| A-22 | 66 | 63 | 57 | 50 | 72 | 69 | 63 | 56 |
| A-23 | 68 | 61 | 56 | 51 | 75 | 68 | 63 | 58 |
| A-24 | 60 | 55 | 48 | 43 | 63 | 58 | 51 | 46 |
| A-25 | 61 | 54 | 49 | 44 | 65 | 58 | 53 | 48 |
| A-26 | 59 | 55 | 49 | 43 | 61 | 57 | 51 | 45 |
| A-27 | 60 | 53 | 48 | 43 | 63 | 56 | 51 | 46 |
| A-28 | 59 | 54 | 48 | 42 | 63 | 58 | 52 | 46 |
| A-29 | 59 | 55 | 49 | 43 | 61 | 57 | 51 | 45 |
| A-30 | 58 | 53 | 47 | 44 | 61 | 56 | 50 | 47 |

TABLE 3

| | Conductive Substance | | | | Ceramic | | Noise (dB) Before Durability Test | | | | Noise (dB) After Durability Test | | | |
|---|---|---|---|---|---|---|---|---|---|---|---|---|---|---|
| No. | Composition | Occupancy (%) | Large Grain Proportion (%) (Lm ≥200 μm) | Fe-containing Oxide | Elements Contained | Porosity (%) | 30 MHz | 100 MHz | 300 MHz | 500 MHz | 30 MHz | 100 MHz | 300 MHz | 500 MHz |
| B-1 | C | 34 | 55 | $(Ni,Zn)Fe_2O_4$ | Si, Mg, Ba, Ca | 5.9 | 80 | 74 | 69 | 65 | 95 | 89 | 85 | 81 |
| B-2 | TiC | 67 | 52 | $Fe_3O_4$ | P, Mg, Ba, Na | 5.6 | 83 | 78 | 73 | 68 | 98 | 89 | 85 | 81 |
| B-3 | C | 48 | 45 | Non-existence | B, Ca, Mg, P, Na, K | 6.1 | 88 | 83 | 78 | 74 | 98 | 93 | 87 | 83 |
| B-4 | $SrTiO_3$ | 61 | 39 | $(Ni,Zn)Fe_2O_4$ | Si, P, Mg, Ba, Li | 5.3 | 85 | 80 | 75 | 70 | 100 | 91 | 87 | 83 |
| B-5 | Non-existence | — | — | $BaFe_{12}O_{19}$ | B, Ca, Mg, P, Na, K | 5.3 | — | — | — | — | — | — | — | — |

In the evaluation tests, 35 types of samples including A-1 to A-30 samples and B-1 to B-5 samples, in which the properties of the magnetic substance structures 200*d* are different from each other, were evaluated. Tables 2 and 3 illustrate sample numbers, the properties (here, the properties of a conductive substance, the properties of an iron-containing oxide, elements contained in the ceramic, and porosity) of the magnetic substance structure 200*d*, and noise test results before and after durability tests. The remainder of the configurations of the 35 types of samples of the spark plug 100*d* was the same except for the properties of the magnetic substance structure 200*d*. For example, the magnetic substance structures 200*d* in the 35 types of samples had substantially the same shape. The magnetic substance structure 200*d* had an outer diameter (that is, the inner diameter of a portion of the through hole 12*d* which accommodated the magnetic substance structure 200*d*) of 3.9 mm.

The composition of the conductive substance, occupancy, and a large grain proportion are illustrated as the properties of the conductive substance. The composition of the conductive substance was specified from the material of the conductive substance. The occupancy is a proportion of the total area of the conductive region 820 in the target region 800 to the total area of the target region 800 illustrated in FIG. 5. The occupancy was calculated as follows. The magnetic substance structure 200*d* of each of the samples was cut along a plane including the center axis CL, and the cross-section of the magnetic substance structure 200*d* was mirror-polished. A region containing a 1.5 mm×2.0 mm region corresponding to the target region 800 (refer to FIG. 5) on the cross-section was analyzed using an electron probe microanalyzer (EPMA). Conditions for the EPMA analysis were set as follows. That is, the acceleration voltage of the EPMA was set to 15.0 kV, the working distance was set to 11.0 mm, and a beam diameter was set to 50 μm. The conductive region 820 was specified by image processing of adopting a region, in which the elements of the conductive substance were detected by the EPMA analysis, as the conductive region 820. An image illustrating the conductive region 820 as illustrated in the target region 800 on the center upper side of the FIG. 5 was acquired by this image processing. The occupancy was calculated by analyzing this image.

The large grain proportion is a proportion of the total number of grain regions 825 with the maximum grain size Lm of 200 μm or greater to the total number of grain regions 825 in the target region 800 (refer to FIG. 5). The plurality of grain regions 825 in the target region 800 were specified by using the conductive region 820 specified by the EPMA analysis and the image processing. When only a portion of one grain region 825 was positioned in the target region 800, that is, a portion of one grain region 825 protruded out of the target region 800, the one grain region 825 was treated as one grain region 825 present in the target region 800 in counting the number of grain regions 825.

The composition of the iron-containing oxide was specified from the material of the magnetic substance structure 200*d*.

The elements contained in the ceramic were specified from the elements contained in the ceramic material (in these evaluation tests, an amorphous glass material). The tables 2 and 3 illustrate elements other than oxygen. For example, when "$SiO_2$" is used as the ceramic material, "Si" without denotation of oxygen (O) is illustrated. Various additive components may be added to the ceramic material. Tables 2 and 3 illustrate these additive component elements (for example, Ca and Na). Elements contained in the ceramic region 810 can be specified by EPMA analysis.

The porosity is a proportion of an area the pores 812 (refer to FIG. 5) to an area of the remainder of the target region 800 which is other than the conductive region 820. The porosity was calculated as follows. An image of the region equivalent to the target region 800 (refer to FIG. 5) used in the EPMA analysis was captured using a scanning electron microscope (SEM), with the region being present on the same polished surface used in the EPMA analysis. The obtained SEM images were binarized using image analysis software (Analysis Five manufactured by Soft Imaging System GmbH). A threshold value for the binarization was set as follows.

(1) An operator defined the position of a grain boundary by confirming a secondary electron image and a backscattered electron image on the SEM image, and drawing a line along a dark boundary (equivalent to the grain boundary) in the backscattered electron image.

(2) In order to improve the backscattered electron image, the operator smoothened the backscattered electron image while maintaining the edge of the grain boundary.

(3) The operator made a graph from the backscattered electron image with the graph showing brightness on the horizontal axis and an incidence on the vertical axis. The obtained graph was a bimodal graph. The brightness of a middle point between two peaks was set as the threshold value for binarization.

The pores 812 in the ceramic region 810 were specified by the binarization. Differentiation between the ceramic region 810 and the conductive region 820 on the SEM image was made by the EPMA analysis. The proportion of the area of the pores 812 to the area of the remainder of the target region 800 other than the conductive region 820 was calculated as the porosity.

An average value of 10 values obtained by analyzing 10 cross-sectional images of the magnetic substance structure 200*d* was adopted as the occupancy, the large grain proportion, the porosity, and the like. Ten cross-sectional images of one type of samples were captured using 10 cross-sections of 10 samples of the same type which were manufactured under the same conditions.

In a noise test, a noise intensity was measured according to "automotive—radio noise characteristics—section 2: measurement method of preventive device, current method" of Japanese Automotive Standards Organization D-002-2 (JASO D-002-2). Specifically, the distance of the gap g of the spark plug sample was adjusted to 0.9 mm±0.01 mm, a voltage in a range of from 13 kV to 16 kV was applied to the sample, and discharge was performed. Current flowing through the terminal metal fixture 40*d* during discharge was measured using a current probe, and the measured value was converted into the unit of dB for comparison. Noise at four types of frequencies, that is, 30 MHz, 100 MHz, 300 MHz, and 500 MHz was measured. Each numerical value in the tables denotes a noise intensity with respect to a predetermined reference. The noise intensity becomes high as the numerical value becomes larger. A "before durability test" denotes a noise test result before a durability test to be described later is performed, and an "after durability test" denotes a noise test result after the durability test is performed. The durability test is a test in which the spark plug samples are discharged with a discharge voltage of 20 kV at a temperature of 200 degrees Celsius for 400 hours. The durability test may cause the progress of the aging of the magnetic substance structure 200*d*. A noise intensity "after the durability test" may be higher than a noise intensity "before the durability test" due to the progress of the aging of the magnetic substance structure 200*d*.

As illustrated in Tables 2 and 3, both of the noise intensities after and before the durability test became lower as the frequency became higher.

F-2. Regarding Occupancy of Conductive Substance

The occupancy of the conductive substance in each of the A-1 to A-6 samples in Table 2 was in a range of 35% or greater and 65% or less. In the A-1 to A-6 samples, it was possible to realize a sufficiently low noise intensity of 76 dB or less at all of the frequencies before the durability test. A noise intensity even after the durability test was less than or equal to 86 dB at all of the frequencies, and it was possible to suppress an increase in the noise intensity. That is, it was possible to realize good durability of the magnetic substance structure 200*d*. The increased amounts of noise intensity at all of the frequencies induced by the durability test were in a range of 9 dB or greater and 11 dB or less.

The occupancy of the B-1 sample in Table 3 was 34% (the large grain proportion was 55%) which was less than the occupancy of each of the A-1 to A-6 samples. Before and after the durability test, the noise intensities of the B-1 sample were higher than those of an arbitrary sample of the A-1 to A-6 samples at the same frequency. The difference in noise intensity at the same frequency between the B-1 sample and an arbitrary sample of the A-1 to A-6 samples was greater than or equal to 3 dB before the durability test, and was greater than or equal to 7 dB after the durability test.

The increased amounts of the noise intensity of the B-1 sample induced by the durability test were 15 dB (at 30 MHz and 100 MHz) and 16 dB (at 300 MHz and 500 MHz). The increased amounts (9 dB, 10 dB, and 11 dB) of noise intensity of the A-1 to A-6 samples were less by approximately 5 dB than the increased amount (15 dB and 16 dB) of noise intensity of the B-1 sample at the same frequency. That is, the A-1 to A-6 samples with relatively high occupancy were capable of realizing good durability compared to the B-1 sample with relatively low occupancy. The estimated reason for this is that when the occupancy is high, the current path formed by the conductive region 820 (refer to FIG. 5) is large, and a large number of current paths are formed by the conductive region 820 compared to when the occupancy is low.

The occupancy of the conductive substance of the B-2 sample in Table 3 was 67% (the large grain proportion was 52%) which was greater than the occupancy of the conductive substance of each of the A-1 to A-6 samples. Before the durability test, the noise intensity of the B-2 sample was higher than that of an arbitrary sample of the B-1 sample and the A-1 to A-6 samples at the same frequency. After the durability test, the noise intensity of the B-2 sample was approximately equal to that of the B-1 sample at the same frequency, and was higher than that of an arbitrary sample of the A-1 to A-6 samples at the same frequency. As such, the A-1 to A-6 samples with relatively low occupancy were capable of suppressing noise compared to the B-2 sample with relatively high occupancy. The estimated reason for this is that the distribution region of the conductor (the iron-containing oxide) in the vicinity of the conductive path becomes increased as the occupancy of the conductive substance becomes lower.

The occupancy of the conductive substances of the A-1 to A-6 samples realizing good durability while suppressing noise were 35%, 48%, 52%, 58%, 61%, and 65%. An arbitrary value among these six values can be adopted as the upper limit of a preferable range (range of a lower limit or greater and an upper limit or less) of the occupancy. An arbitrary value less than or equal to the upper limit among these values can be adopted as the lower limit. For example, a value in a range of 35% or greater and 65% or less can be adopted as the occupancy.

An arbitrary method can be adopted as a method of adjusting the occupancy. For example, it is possible to increase the occupancy by increasing the percent (weight percent) of the conductive substance in the material of the magnetic substance structure 200*d*.

F-3. Regarding Large Grain Proportion

The large grain proportion of the conductive substance of each of the A-1 to A-6 samples in Table 2 was greater than or equal to 40%. As described above, the A-1 to A-6 samples were capable of realizing good durability while suppressing noise. The large grain proportion of the conductive substance of the B-4 sample in Table 3 was 39% (the occupancy was 61%) which was less than that of each of the A-1 to A-6 samples. Before and after the durability test, the noise intensities of the B-2 sample were higher than those of an arbitrary sample of the A-1 to A-6 samples at the same frequency. Before and after the durability test, the difference between the noise intensities of the B-2 sample were higher than those of an arbitrary sample of the A-1 to A-6 samples at the same frequency. the difference in noise intensity between an arbitrary sample of the A-1 to A-6 samples and the B-4 sample was greater than or equal to 9 dB.

The increased amounts of the noise intensity of the B-4 sample induced by the durability test were 15 dB (at 30 MHz), 11 dB (at 100 MHz), 12 dB (at 300 MHz), and 13 dB (at 500 MHz). The increased amounts of noise intensity of an arbitrary sample of the A-1 to A-6 samples at 30 MHz, 300 MHz, and 500 MHz were less than the increased amounts of noise intensity of the B-4 sample at the same frequency. The increased amount (11 dB) of noise intensity of each of the A-3 and A-6 samples at 100 MHz was equal to that of the B-4 sample. The increased amount of noise intensity of an arbitrary sample of the A-1, the A-2, the A-4, and the A-5 samples at 100 MHz was less than the increased amount (11 dB) of noise intensity of the B-4 sample. As such, the A-1 to A-6 samples with a relatively high large grain proportion were capable of realizing good durability compared to the B-4 sample with a relatively low large grain proportion. The estimated reason for this is that when the large grain proportion is high, the current path formed by the conductive region 820 (refer to FIG. 5) is large compared to when the large grain proportion is low.

The large grain proportion of the conductive substances of the A-1 to A-6 samples realizing good durability while suppressing noise were 40%, 45%, 51%, 55%, 77%, and 92%. An arbitrary value among these six values can be adopted as the upper limit of a preferable range (range of a lower limit or greater and an upper limit or less) of the large grain proportion. An arbitrary value less than or equal to the upper limit among these values can be adopted as the lower limit. For example, a value in a range of 40% or greater and 92% or less can be adopted as the large grain proportion. It is estimated that even if the large grain proportion is a larger value (for example, 100%), it is possible to suppress noise by setting the occupancy of the conductive substance in the aforementioned preferable range. Accordingly, 100% may be adopted as the upper limit of the preferable range of the large grain proportion. For example, an arbitrary value greater than or equal to 40% can be adopted as the large grain proportion.

An arbitrary method can be adopted as a method of adjusting the large grain proportion. For example, it is possible to increase the large grain proportion by increasing the particle size of the material powder of the conductive substance. A binder may be added to and mixed with the material powder of the conductive substance before the material powder of the conductive substance is mixed with other materials. Accordingly, a plurality of conductive material grains are stuck together by the binder, thereby resulting in formation of grain-like portions having a large diameter. As a result, it is possible to increase the large grain proportion.

F-4. Regarding Occupancy and Large Grain Proportion of Conductive Substance, and Material of Magnetic Substance Structure 200*d*

The following materials were used to manufacture the A-1 to A-6 samples realizing good durability while suppressing noise. A material selected from the following materials was used as the conductive substance of the magnetic substance structure 200*d*: carbon (C), carbon oxides ($Cr_3C_2$ and TiC), perovskite type oxides ($SrTiO_3$ and $SrCrO_3$), and metal (titanium (Ti)). A material selected from the following materials was used as the magnetic substance of the magnetic substance structure 200*d*: iron oxides ($Fe_2O_3$, $Fe_3O_4$, and FeO), a spinel ferrite ((Ni, Zn)$Fe_2O_4$), and hexagonal ferrites ($BaFe_{12}O_{19}$ and $SrFe_{12}O_{19}$). The ceramic of the magnetic substance structure 200*d* contained at least one of silicon (Si), boron (B), and phosphorous (P).

Typically, in many cases, when the type of a second material is the same as that of a first material, the second material has similar characteristics as those of the first material. Accordingly, it is estimated that even if other materials of the same type are used instead of the aforementioned materials of the magnetic substance structure 200*d*, the aforementioned preferable ranges can be applied to a preferable range of the occupancy of the conductive substance, and a preferable range of the large grain proportion of the conductive substance. For example, it is estimated that when the magnetic substance structure 200*d* has any one of the following properties Z1 to Z3, the preferable range of the occupancy and the preferable range of the large grain proportion can be applied.

[Properties Z1] The magnetic substance structure 200*d* contains a conductive substance as a conductor.

[Properties Z2] The magnetic substance structure 200*d* contains an iron-containing oxide as a magnetic substance.

[Properties Z3] The magnetic substance structure 200*d* contains ceramic containing at least one of silicon (Si), boron (B), and phosphorous (P).

The conductive substance contained in the magnetic substance structure 200*d* preferably contains at least one of carbon, a carbon dioxide, a perovskite type oxide, and metal. However, other conductive substances may be adopted.

F-5. Regarding Type of Perovskite Type Oxide

The A-7 to A-14 samples in Table 2 were samples using various perovskite type oxides as conductive substances. Specifically, the conductive substances were $LaMnO_3$, $LaCrO_3$, $LaCoO_3$, $LaFeO_3NdMnO_3$, $PrMnO_3$, $YbMnO_3$, and $YMnO_3$ in the order of the A-7 to A-14 samples. These oxides are represented by general formula $ABO_3$. A leading element A (for example, "La" of $LaMnO_3$) is an A-site element, and a subsequent element B (for example, "Mn" of $LaMnO_3$) is a B-site element. When a cubic crystal has a non-distorted crystal structure, a B site is a 6-coordinated site, and is surrounded by an octahedron formed of oxygen. An A site is a 12-coordinated site.

The occupancy of the conductive substance of each of the A-7 to A-14 samples was 39% or greater and 64% or less. The large grain proportion was greater than or equal to 40%. The magnetic substances were (Ni,Zn)$Fe_2O_4$, $NiFe_2O_4$, $Fe_2O_3$, (Ni,Zn)$Fe_2O_4$, (Mn,Zn)$Fe_2O_4$, $Ba_2Co_2Fe_{12}O_{22}$, (Ni, Zn)$Fe_2O_4$, and $CuFe_2O_4$ in the order of the sample numbers. The ceramic of the magnetic substance structure 200*d* contained at least one of Si, B, and P.

As illustrated in Table 2, before and after the durability test, the noise intensities of the A-7 to A-14 samples were lower than those of an arbitrary sample of the A-1 and A-6 samples at the same frequency. As such, it was possible to further suppress noise by using perovskite type oxides as the conductive substances of the A-7 to A-14 samples.

The increased amount of noise intensity of each of the A-7 to A-14 samples induced by the durability test was 6 dB or 7 dB. In contrast, the increased amounts of noise intensity of the A-1 to A-6 samples induced by the durability test were 9 dB or greater and 11 dB or less, and were greater than those of the A-7 to A-14 samples. As such, it was possible to improve the durability of the magnetic substance structure 200*d* by using perovskite type oxides as the conductive substances of the A-7 to A-14 samples. The estimated reason for this is that the perovskite type oxides of the A-7 to A-14 samples have low electrical resistance and are stable.

The perovskite type oxides of the A-4 and A-5 samples had the same A-site element (Sr), and different B-site elements (Ti and Cr). The A-4 and A-5 samples had a small difference (less than or equal to 2 dB) in noise intensity at the same frequency before the durability test, and also had a small difference (less than or equal to 2 dB) in noise intensity at the same frequency after the durability test. That is, the A-4 and A-5 samples having the same A-site element were capable of realizing the same level of noise suppression capability and the same level of durability.

The A-7 to A-10 samples had the same A-site element (La), and different B-site elements (Mn, Cr, Co, and Fe). The A-7 to A-10 samples had a small difference (less than or equal to 2 dB) in noise intensity at the same frequency before the durability test, and also had a small difference (less than or equal to 2 dB) in noise intensity at the same frequency after the durability test. That is, the A-7 to A-10 samples having the same A-site element were capable of realizing the same level of noise suppression capability and the same level of durability.

It is estimated that it is possible to realize the same level of noise suppression capability and the same level of durability by adopting a plurality of types of perovskite type oxides which have the same A-site element in spite of having different B-site elements. For example, the A-site element of the A-7 to A-14 samples is selected from La, Nd, Pr, Yb, and Y. It is estimated that when the conductive substance of the magnetic substance structure 200*d* contains a perovskite type oxide, the A-site element of which is at least one of La, Nd, Pr, Yb, and Y, similar to the A-7 to A-14 samples, it is possible to suppress noise, and to realize good durability. An oxide having a plurality of types of A-site elements may be adopted as a perovskite type oxide. The conductive substance may contain a plurality of types of perovskite type oxides.

When the material of the conductive substance of the magnetic substance structure 200*d* is unknown, the A-site element of the perovskite type oxide contained in the magnetic substance structure 200*d* of the sample can be specified as follows. For example, the crystal phase of the perovskite type oxide may be specified, and the crystal structure of the specified crystal phase and elements may be specified by analyzing the magnetic substance structure 200*d* using a micro X-ray diffraction method.

F-6. Regarding Type of Metal

The A-15 to A-23 samples in Table 2 were samples using various metals (including alloys) as conductive substances. Specifically, the conductive substances were Ag, Cu, Ni, Sn, Fe, Cr, Inconel, a sendust, and a permalloy in the order of the A-15 to A-23 samples.

The occupancy of the conductive substance of each of the A-15 to A-23 samples was 40% or greater and 65% or less. The large grain proportion was greater than or equal to 44%. The magnetic substances were $CuFe_2O_4$, $BaFe_{12}O_{19}$, $SrFe_{12}O_{19}$, $NiFe_2O_4$, $(Ni,Zn)Fe_2O_4$, $NiFe_2O_4$, $Ba_2Co_2Fe_{12}O_{22}$, $Y_3Fe_5O_{12}$, and $(Mn, Zn)Fe_2O_4$ in the order of the sample numbers. The ceramic of the magnetic substance structure 200*d* contained at least one of Si, B, and P.

As illustrated in Table 2, before and after the durability test, the noise intensities of the A-15 to A-23 samples were lower than those of an arbitrary sample of the A-1 and A-6 samples at the same frequency. As such, it was possible to further suppress noise by using metals as the conductive substances of the A-15 to A-23 samples.

The increased amount of noise intensity of each of the A-15 to A-23 samples induced by the durability test was 6 dB or 7 dB. In contrast, the increased amounts of noise intensity of the A-1 to A-6 samples induced by the durability test were 9 dB or greater and 11 dB or less, and were greater than those of the A-15 to A-23 samples. As such, it was possible to improve the durability of the magnetic substance structure 200*d* by using metals as the conductive substances of the A-15 to A-23 samples. The estimated reason for this is that the metal of each of the A-15 to A-23 samples has good oxidation resistance.

When metal is adopted as a conductive substance, at least one of the metals used in the A-15 to A-23 samples is preferably adopted. For example, a conductive substance preferably contains at least one of Ag, Cu, Ni, Sn, Fe, and Cr. Metals contained in the conductive region 820 of the magnetic substance structure 200*d* can be specified by EPMA analysis.

F-7. Regarding Porosity

The porosity of each of the A-1 to A-6 samples in Table 2 was in a range of 5.3% or greater and 6.1% or less. As described above, the A-1 to A-6 samples were capable of suppressing noise, and realizing good durability. The porosity of each of the A-7 to A-23 samples was in a range of 5.1% or greater and 6% or less. As described above, the A-7 to A-23 samples were capable of further suppressing noise, and realizing better durability.

The porosities of the A-24 and A-30 samples were lower than those of the A-1 to A-23 samples. Specifically, the porosity of each of the A-24 to A-30 samples was in a range of 3.2% or greater and 5% or less. The conductive substances of the A-24 to A-30 samples were $NdMnO_3$, $PrMnO_3$, $YbMnO_3$, $YMnO_3$, Fe, Cr, and Inconel in the order of the sample numbers. The occupancy of the conductive substance was 46% or greater and 64% or less. The large grain proportion was greater than or equal to 52%. The magnetic substances were $(Ni,Zn)Fe_2O_4$, $(Mn,Zn)Fe_2O_4$, $Ba_2CO_2Fe_{12}O_{22}$, $(Ni,Zn)Fe_2O_4$, $BaFe_{12}O_{19}$, $SrFe_{12}O_{19}$, and $NiFe_2O_4$ in the order of the sample numbers. The ceramic of the magnetic substance structure 200*d* contained at least one of Si, B, and P.

As illustrated in Table 2, before and after the durability test, the noise intensities of an arbitrary sample of the A-24 to A-30 samples were lower than those of an arbitrary sample of the A-1 to A-23 samples at the same frequency. As such, the A-24 to A-30 samples with relatively low porosities were capable of suppressing noise compared to the A-1 to A-6 samples and the A-7 to A-23 samples with relatively high porosities. The estimated reason for this is that when the porosity is low, the occurrence of partial discharge in the pore 812 (refer to FIG. 5) is suppressed compared to when the porosity is high.

The increased amounts of the noise intensity of the A-24 to A-30 samples induced by the durability test were in a range of 2 dB or greater and 4 dB or less. In contrast, the increased amounts of noise intensity of the A-1 to A-6 samples were 9 dB or greater and 11 dB or less, and the increased amount of noise intensity of each of the A-7 to A-23 samples was 6 dB or 7 dB. As such, the A-24 to A-30 samples with a relatively low porosity were capable of realizing good durability compared to the A-1 to A-6 samples and the A-7 to A-23 samples with a relatively high porosity. The estimated reason for this is that when the porosity is low, the occurrence of partial discharge in the pores 812 (refer to FIG. 5) is suppressed compared to when the porosity is high.

The porosities of the A-1 to A-30 samples realizing good durability while suppressing noise were 3.2%, 3.3%, 3.5%, 3.8%, 4.3%, 4.4%, 5%, 5.1%, 5.2%, 5.3%, 5.4%, 5.5%, 5.6%, 5.7%, 5.8%, 6%, and 6.1%. An arbitrary value among these 17 values can be adopted as the upper limit of a preferable range (range of a lower limit or greater and an upper limit or less) of the porosity. An arbitrary value less than or equal to the upper limit among these values can be adopted as the lower limit. For example, a value in a range of 3.2% or greater and 6.1% or less can be adopted as the porosity.

As described above, the A-24 to A-30 samples were capable of suppressing noise, and durability of the A-24 to A-30 samples could be improved compared to the A-1 to A-23 samples. The porosities of the A-24 to A-30 were 3.2%, 3.3%, 3.5%, 3.8%, 4.3%, 4.4% and 5%. When the upper limit and the lower limit of a preferable range are selected from these seven values, it is possible to further improve noise suppression capability and durability. For example, a value in a range of 3.2% or greater and 5% or less can be adopted as the porosity.

It is estimated that the noise suppression capability and the durability become better as the porosity becomes lower. Accordingly, 0% may be adopted as the lower limit of the porosity. For example, preferably, the porosity is 0% or greater and 6.1% or less, and more preferably, is 0% or greater and 5% or less.

The noise suppression capability of the A-1 to A-6 samples is good compared to the capability of typical spark plugs (for example, spark plug from which the magnetic substance structure 200*d* is omitted). Accordingly, it is estimated that even if the porosity is higher, it is possible to realize practical noise suppression capability. As a result, it is estimated that a higher value (for example, 10%) can be adopted as the upper limit of the porosity.

An arbitrary method can be adopted as a method of adjusting the porosity. For example, when the firing temperature (heating temperature of the insulator 10*d* accommodating the material of the connection portions 300*d* in the through hole 12*d*) of the magnetic substance structure 200*d* is increased, the ceramic material of the magnetic substance structure 200*d* is easily melted, and thus it is possible to reduce the porosity. It is possible to block the pores 812, and to reduce the porosity by increasing force which is applied to the terminal metal fixture 40*d* when the terminal metal fixture 40*d* is inserted into the through hole 12*d*. It is possible to reduce the porosity by reducing the particle size of the ceramic material of the magnetic substance structure 200*d*.

F-8. Regarding Conductive Substance

The B-5 sample in Table 3 was a sample in which a conductive substance was omitted from the magnetic substance structure 200*d*. The electromagnetic noise of the B-5 sample was too strong, and thus it was possible to measure an exact value of the electromagnetic noise. The estimated reason for this is that current is not capable of smoothly flowing through the magnetic substance structure 200*d*, and partial discharge occurs in the magnetic substance structure 200*d*. In contrast, the A-1 to A-30 were capable of suppressing noise. As such, it was possible to suppress noise by making the magnetic substance structure 200*d* containing the conductive substance. It is estimated that conductive substances capable of suppressing electromagnetic noise are not limited to the conductive substances contained in the samples in Table 2, and various types of conductive substances can be adopted. A conductive substance having good oxidation resistance is preferably adopted so as to realize good durability of the magnetic substance structure 200*d*. It is possible to suppress aging caused by heat generation resulting from the flow of large current by adopting a conductive substance with an electrical resistivity of 50 Ω·m or less.

F-9. Regarding Iron-containing Oxide

The B-3 sample in Table 3 was a sample in which an iron-containing oxide (that is, a magnetic substance) was omitted from the magnetic substance structure 200*d*. As illustrated in Tables 2 and 3, noise intensities of the A-1 to A-30 samples containing the iron-containing oxide were lower than the noise intensity of the B-3 sample at the same frequency. As such, it was possible to suppress noise by making the magnetic substance structure 200*d* containing the iron-containing oxide. The reason for this is that electromagnetic noise is suppressed by the magnetic substance disposed in the vicinity of the current path. Iron-containing oxides containing at least one of FeO, $Fe_2O_3$, $Fe_3O_4$, Ni, Mn, Cu, Sr, Ba, Zn, and Y can adopted as the iron-containing oxides of the A-1 to A-30 samples. It is estimated that iron-containing oxides capable of suppressing electromagnetic noise are not limited to the iron-containing oxides contained in the samples in Table 2, and various types of iron-containing oxides (for example, various ferrites) can be adopted.

F-10. Regarding Ceramic

The ceramic contained in the magnetic substance structure 200*d* supports the conductive substance and the magnetic substance (iron-containing oxide). Various ceramics can be adopted as the ceramic supporting the conductive substance and the magnetic substance. For example, amorphous ceramic may be adopted. Glass containing one or more components arbitrarily selected from $SiO_2$, $B_2O_3$, $P_2O_5$, and the like can be adopted as the amorphous ceramic. Instead, crystalline ceramic may be adopted. Crystallized glass (also referred to as glass ceramic) such as $Li_2O$—$Al_2O_3$—$SiO_2$ glass may be adopted as the crystalline ceramic. In any case, it is estimated that it is possible to realize proper noise suppression capability and proper durability by adopting a ceramic containing at least one of silicon (Si), boron (B), and phosphorous (P) as with the A-1 to A-30 samples in Table 2.

E. Modification Example (1) The material of the magnetic substances 210 and 210*b* is not limited to a MnZn ferrite, and various magnetic materials can be adopted. For example, various ferromagnetic materials can be adopted. The ferromagnetic material is a material which is spontaneously magnetized. Various materials, for example, materials containing iron oxides such as ferrites (including a spinel type ferrite), and an iron alloy such as alnico (Al—Ni—Co) can be adopted as the ferromagnetic materials. It is possible to appropriately suppress electromagnetic noise by adopting the ferromagnetic material. The material of the magnetic substances 210 and

210*b* is not limited to the ferromagnetic materials, and a paramagnetic material may be adopted. It is also possible to suppress electromagnetic noise in this case.

(2) The configuration of the magnetic substance structure is not limited to the configurations illustrated in FIGS. 1 and 2, and various configurations including a magnetic substance and a conductor can be adopted. For example, a coil-shaped conductor may be embedded in a magnetic substance. Typically, a configuration, in which the conductor is connected in parallel with at least a part of the magnetic substance on the conductive path connecting the end of the magnetic substance structure on the leading end direction D1 side to the end of the magnetic substance structure on the rear end direction D2 side, is preferably adopted. When such a configuration is adopted, the magnetic substance is capable of suppressing electromagnetic noise. Since the conductor is capable of reducing the end-to-end resistance of the magnetic substance structure, it is possible to suppress an increase in the temperature of the magnetic substance structure. As a result, it is possible to suppress the occurrence of damage to the magnetic substance structure.

As illustrated in FIGS. 4 and 5, the magnetic substance structure may be configured to adopt a member in which a conductive substance (conductor), a magnetic substance, and a ceramic are mixed together. The conductive substance may contain a plurality of types of conductive substances (for example, both of metal and a perovskite type oxide). The magnetic substance may contain a plurality of types of iron-containing oxides (for example, both of $Fe_2O_3$ and a hexagonal ferrite ($BaFe_{12}O_{19}$)). The ceramic may contain a plurality of types of components (for example, both of $SiO_2$ and $B_2O_3$). In any case, a combination of the conductive substance, an iron-containing oxide as the magnetic substance, and the ceramic is not limited to the combinations of those materials in the samples in Tables 2 and 3, and other various combinations can be adopted. In any case, the composition of the conductive substance and the composition of the iron-containing oxide can be specified by various methods. For example, the compositions may be specified by a micro X-ray diffraction method.

(3) Instead of the method by which the materials of the magnetic substance structure 200*d* are disposed and fired in the through hole 12*d* of the insulator 10*d*, other arbitrary methods can be adopted to manufacture the magnetic substance structure 200*d* illustrated in FIGS. 4 and 5. For example, the materials of the magnetic substance structure 200*d* may be molded into a tubular shape using a molding die, and the molded body may be fired to produce a fired magnetic substance structure 200*d* having a tubular shape. The fired magnetic substance structure 200*d* may be inserted into the through hole 12*d* instead of inserting the material powders of the magnetic substance structure 200*d* when the through hole 12*d* of the insulator 10*d* is filled with the material powders of other members 60*d*, 70*d*, 75*d*, and 80*d*. It is possible to form the conductive sealing portions 60*d*, 75*d*, and 80*d*, and the resistor 70*d* by inserting the terminal metal fixture 40*d* into the through hole 12*d* through the rear opening 14 with the insulator 10*d* heated.

(4) The configuration of the magnetic substance structure is not limited to the configurations illustrated in FIGS. 1, 2, 4, and 5, and other various configurations can be adopted. For example, the configurations of the magnetic substance structure 200*d* illustrated in FIGS. 4 and 5 may be applied to the magnetic substance structures 200 and 200*b* in FIGS. 1 and 2. For example, members with the same configuration as those of the magnetic substance structures 200*d* illustrated in FIGS. 4 and 5 may be adopted as the magnetic substances 210 and 210*b* in FIGS. 1 and 2. The configurations of the spark plugs 100 and 100*b* illustrated in FIGS. 1 and 2 may be applied to the spark plug 100*d* illustrated in FIGS. 4 and 5. For example, the outer circumferential surface of the magnetic substance structure 200*b* illustrated in FIG. 4 may be covered with a similar covering portion as the covering portions 290 and 290*b* in FIGS. 1 and 2. The magnetic substance structure 200*d* may be formed in such a way that the end-to-end resistance of the magnetic substance structure 200*d* is in the aforementioned preferable range of the end-to-end resistance of the magnetic substance structures 200 and 200*b* (for example, is in a range of 0 kΩ or greater and 3 kΩ or less, or in a range of 0 kΩ or greater and 1 kΩ or less). However, the end-to-end resistance of the magnetic substance structure 200*d* may be out of the aforementioned preferable range. At least one of the resistors 70 and 70*d*, and the sealing portions 60, 60*d*, 75, 75*b*, 75*d*, 80, 80*b*, and 80*d* may contain crystalline ceramic. The magnetic substance structure 200*d* may be disposed closer to the leading end direction D1 side than the resistor 70*d*.

(5) The configuration of the spark plug is not limited to the configurations illustrated from FIGS. 1 and 2, Table 1, FIGS. 4 and 5, and Tables 2 and 3, and various configurations can be adopted. For example, a noble metal tip may be provided in a portion of the center electrode 20 in which the gap g is formed. A noble metal tip may be provided in a portion of the ground electrode 30 in which the gap g is formed. An alloy containing noble metal such as iridium or platinum can be adopted as the material of the noble metal tip.

In the embodiments, the leading end portion 31 of the ground electrode 30 faces the leading end surface 20*s*1 (surface facing the leading end direction D1 side of the center electrode 20) to form the gap g. Instead, the leading end portion of the ground electrode 30 may face the outer circumferential surface of the center electrode 20 to form a gap.

The present invention has been described based on the embodiments and the modification examples; however, the embodiments of the invention are given to help easy understanding of the present invention, and do not limit the present invention. The present invention can be modified and improved insofar as the modification and the improvements do not depart from the purport and the claims of the present invention.

INDUSTRIAL APPLICABILITY

This disclosure can be suitably used in a spark plug of an internal combustion engine or the like.

REFERENCE SIGNS LIST

5: gasket
6: first rear end-side packing
7: second rear end-side packing
8: front end-side packing
9: talc
10, 10*c*, 10*d*: insulator (ceramic insulator)
10*i*: inner circumferential surface
11: second reduced outer diameter portion
12, 12*c*, 12*d*: through hole (axial hole)
13: nose portion
14: rear opening
15: first reduced outer diameter portion
16: reduced inner diameter portion
17: leading end side trunk portion

18: rear end-side trunk portion
19: flanged portion
20: center electrode
20s1: leading end surface
21: electrode base member
22: core member
23: head portion
24: flanged portion
25: nose portion
30: ground electrode
31: leading end portion
35: base member
36: core
40, 40*c*, 40*d*: terminal metal fixture
41: cap installation portion
42: flanged portion
43, 43*c*, 43*d*: nose portion
50: metal shell
51: tool engagement portion
52: screw portion
53: crimped portion
54: seat portion
55: trunk portion
56: reduced inner diameter portion
58: deformed portion
59: through hole
60, 60*d*: first conductive sealing portion
70, 70*d*: resistor
75, 75*b*, 75*c*, 75*d*: second conductive sealing portion
80, 80*b*, 80*d*: third conductive sealing portion
100, 100*b*, 100*c*, 100*d*: spark plug
200, 200*b*, 200*d*: magnetic substance structure
210, 210*b*: magnetic substance
220, 220*b*: conductor
290, 290*b*: covering portion
300, 300*b*, 300*c*, 300*d*: connection portion
800: target region
810: ceramic region
812: pore
812*a*, 812*b*: protruding portion
820: conductive region
825: conductive grain region
g: gap
CL: center axis (axial line)

Having described the invention, the following is claimed:

1. A spark plug comprising:

an insulator having a through hole extending in a direction of an axial line;

a center electrode, at least a part of which is inserted into a leading end side of the through hole;

a terminal metal fixture, at least a part of which is inserted into a rear end side of the through hole; and a connection portion connecting the center electrode and the terminal metal fixture together in the through hole, wherein the connection portion includes:

a resistor; and a magnetic substance structure including a magnetic substance and a conductor and being disposed on a leading end side or a rear end side of the resistor while being positioned away from the resistor, wherein, among the resistor and the magnetic substance structure, when a member disposed on a leading end side is defined as a first member and a member disposed on a rear end side is defined as a second member, the connection portion further includes:

a first conductive sealing portion that is disposed on a leading end side of the first member and is in contact with the first member;

a second conductive sealing portion that is disposed between the first member and the second member and is in contact with the first member and the second member; and a third conductive sealing portion that is disposed on a rear end side of the second member and is in contact with the second member, wherein the magnetic substance structure contains:

(1) a conductive substance as the conductor;

(2) an iron-containing oxide as the magnetic substance; and (3) a ceramic containing at least one of silicon (Si), boron (B), and phosphorous (P), and wherein, in a cross-section of the magnetic substance structure including the axial line, when a target region is defined as a rectangular region having the axial line as a center line, a side of 1.5 mm in a direction perpendicular to the axial line, and a side of 2.0 mm in the direction of the axial line, a region of the conductive substance includes a plurality of grain-shaped regions in the target region, a proportion of a number of grain-shaped regions having a maximum grain size of 200 μm or greater among the plurality of grain-shaped regions is 40% or more, and a proportion of an area of the region of the conductive substance is 35% or greater and 65% or less in the target region.

2. The spark plug according to claim 1, wherein an electrical resistance between a leading end and a rear end of the magnetic substance structure is less than or equal to 3 kΩ.

3. The spark plug according to claim 2, wherein the electrical resistance between the leading end and the rear end of the magnetic substance structure is less than or equal to 1 kΩ.

4. The spark plug according to claim 1, wherein the conductor includes a conductive portion penetrating through the magnetic substance in the direction of the axial line.

5. The spark plug according to claim 1, wherein the magnetic substance structure is disposed on the rear end side of the resistor.

6. The spark plug according to claim 1, wherein the connection portion further includes a covering portion that covers at least a part of an outer surface of the magnetic substance structure while being interposed between the magnetic substance structure and the insulator.

7. The spark plug according to claim 1, wherein the magnetic substance is made of a ferromagnetic material containing an iron oxide.

8. The spark plug according to claim 7, wherein the ferromagnetic material is a spinel type ferrite.

9. The spark plug according to claim 1, wherein the magnetic substance is a NiZn ferrite or a MnZn ferrite.

10. The spark plug according to claim 1, wherein the conductive substance contains a perovskite type oxide which is represented by general formula $ABO_3$ and an A site in the general formula is at least one of La, Nd, Pr, Yb, and Y.

11. The spark plug according to claim 1,
wherein the conductive substance contains at least one metal of Ag, Cu, Ni, Sn, Fe, and Cr.

12. The spark plug according to claim 1,
wherein, in the target region in the cross-section of the magnetic substance structure, a porosity of a remainder of the target region other than the region of the conductive substance is less than or equal to 5%.

* * * * *